US011288955B2

(12) United States Patent
Cohn et al.

(10) Patent No.: US 11,288,955 B2
(45) Date of Patent: Mar. 29, 2022

(54) TRAFFIC ANALYSIS BASED ON HISTORICAL GLOBAL POSITIONING SYSTEM DATA

(75) Inventors: Nicholas David Cohn, Amsterdam (NL); Ingo Schurr, Berlin (DE); Gregor Wuensch, Berlin (DE)

(73) Assignee: TOMTOM INTERNATIONAL B.V., Amsterdam (NL)

( * ) Notice: Subject to any disclaimer, the term of this patent is extended or adjusted under 35 U.S.C. 154(b) by 1189 days.

(21) Appl. No.: 12/654,392

(22) Filed: Dec. 18, 2009

(65) Prior Publication Data

US 2011/0153183 A1 Jun. 23, 2011

(51) Int. Cl.

| | |
|---|---|
| ***G08G 1/01*** | (2006.01) |
| ***G08G 1/0968*** | (2006.01) |
| *G08G 1/0969* | (2006.01) |

(52) U.S. Cl.

CPC ..... *G08G 1/0104* (2013.01); *G08G 1/0112* (2013.01); *G08G 1/0129* (2013.01); *G08G 1/096855* (2013.01); *G08G 1/0969* (2013.01)

(58) Field of Classification Search

CPC .. G08G 1/0104; G08G 1/0112; G08G 1/0129; G08G 1/095; G08G 1/096855; G08G 1/0969; G01C 21/3415

USPC ..... 701/117, 20, 412, 446, 517; 700/66; 340/995.1, 907, 911; 370/252; 705/6

See application file for complete search history.

(56) References Cited

U.S. PATENT DOCUMENTS

| | | | | |
|---|---|---|---|---|
| 6,650,948 | B1 * | 11/2003 | Atkinson et al. | 700/66 |
| 7,269,507 | B2 * | 9/2007 | Cayford | 701/446 |
| 7,440,842 | B1 * | 10/2008 | Vorona | 701/117 |
| 2007/0106465 | A1 * | 5/2007 | Adam et al. | 701/209 |
| 2007/0171095 | A1 * | 7/2007 | Mochizuki | G08G 1/0104 340/995.13 |
| 2007/0189181 | A1 * | 8/2007 | Kirk | G01S 19/14 370/252 |
| 2008/0071465 | A1 * | 3/2008 | Chapman | G01C 21/3691 701/117 |
| 2008/0177470 | A1 * | 7/2008 | Sutardja | 701/210 |
| 2009/0271105 | A1 * | 10/2009 | Kindo | G09B 29/007 701/439 |
| 2011/0121993 | A1 * | 5/2011 | Davis | G08G 1/07 340/911 |

OTHER PUBLICATIONS

International Search Report dated Sep. 28, 2010 for International Application No. PCT/EP2009/067556.

* cited by examiner

*Primary Examiner* — Isaac G Smith

(74) *Attorney, Agent, or Firm* — Park, Vaughan, Fleming & Dowler LLP

(57) ABSTRACT

A method of analyzing traffic by a system includes receiving sequential location measurements from users of the system, mapping the received sequential location measurements to a digital map and determining traffic information for a first time period based on mapped sequential location measurements corresponding to the first time period. A system may include a database configured to store sequential location measurements received from users of the system and a processor configured to extract sequential location measurements from the database and determine traffic information for a first period based on the extracted sequential location measurements. The sequential location measurements include periodic times and associated coordinates.

22 Claims, 17 Drawing Sheets

| Period | Travel Times |
|---|---|
| AM Peak (7:30-8:30) | 42 min. |
| PM Peak (17:00-18:00) | 44 min. |
| Off Peak (11:00-12:00) | 32 min. |

900

| TOMTOM | Travel Time Report:<br>Almere - Amsterdam | X<br>X<br>X |
|---|---|---|

1 Introduction

This document lists the travel times for travelling by car from Almere to Amsterdam.
The route taken is shown in Illustration 1.

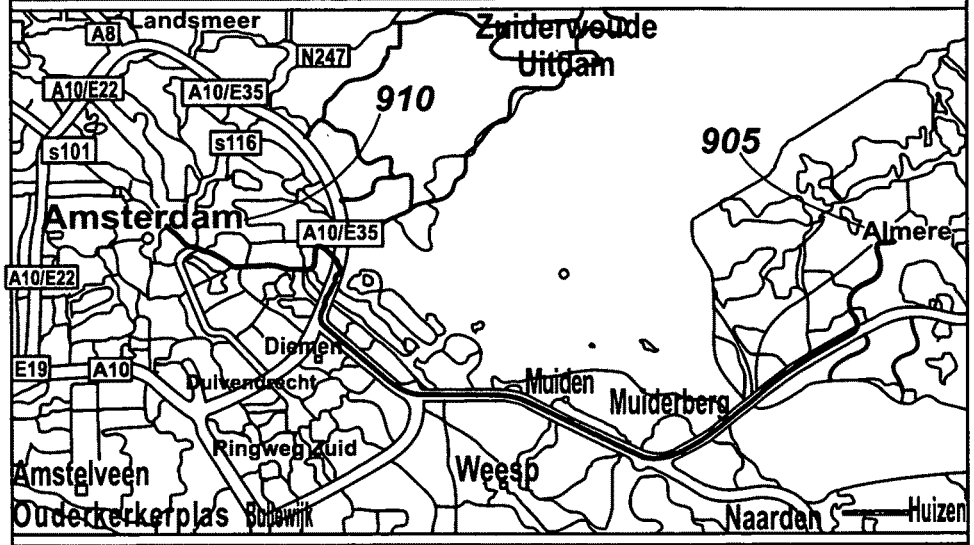

*Illustration 1: The route from Almere to Amsterdam.*

2 Results

For the reported period the travel times are shown in the following table.

| Period | Travel Times |
|---|---|
| AM Peak (7:30-8:30) | 42 min. |
| PM Peak (17:00-18:00) | 44 min. |
| Off Peak (11:00-12:00) | 32 min. |

*Fig. 9A*

TRAFFIC ANALYSIS BASED ON HISTORICAL GLOBAL POSITIONING SYSTEM DATA

FIELD

The present application generally relates to navigation devices and traffic analysis methods.

BACKGROUND

Governments, corporations and other bodies conduct transportation planning to ease traffic and reduce travel time. In transportation planning, governments need information regarding road infrastructure and traffic analysis to make proper decisions.

Conventionally, traffic analysis was obtained doing limited surveys. These surveys include drivers liming a specific route using a stop watch or temporarily placing cameras along a road to match license plates and monitor the traffic. However, surveys are costly and result in limited samples.

Inductive loops or cameras may be placed in a road to measure speed and how many drivers use that road. However, inductive loops or cameras are generally very costly and time consuming.

In recent years, consumers have been provided with a variety of devices and systems to enable them to locate places on a digital map using GPS (Global Positioning System) signal reception and processing functionality. The term "place" is a general term used throughout the description of example embodiments. The term "place" includes street addresses, buildings located at street addresses such as businesses and landmarks, and facilities located at a number of street addresses such as shopping malls and business parks. The variety of devices and systems used by consumers are in the form of in-vehicle navigation systems that enable drivers to navigate over streets and roads; hand-held devices such as personal digital assistants ("PDAs"), personal navigation devices (PNDs), and cell phones or other types of mobile devices that can do the same; desktop applications, and Internet applications in which users can generate maps showing desired places. The common aspect in all of these and other types of devices and systems is a map database of geographic features, vectors and attributes, and software to access, manipulate and navigate the map database in response to user inputs.

SUMMARY

In at least one example embodiment, a method of analyzing traffic by a system is disclosed. The method includes receiving sequential location measurements from users of the system, mapping the received sequential location measurements to a digital map, and determining traffic information for a first time period based on mapped sequential location measurements corresponding to the first time period.

In another example embodiment, a system includes a database configured to store sequential location measurements received from users of the system and a processor configured to extract sequential location measurements from the database and determine traffic information for a first period based on the extracted sequential location measurements. The sequential location measurements include periodic times and associated coordinates.

Another example embodiment provides computer software including one or more software modules operable, when executed in an execution environment, to cause a processor to connect to a database configured to store sequential location measurements received from users of the system and extract sequential location measurements from the database and determine traffic information for a first period based on the extracted sequential location measurements. The sequential location measurements include periodic times and associated coordinates.

BRIEF DESCRIPTION OF THE DRAWINGS

The present application will be described in more detail below by using example embodiments, which will be explained with the aid of the drawings, in which:

FIG. 9A illustrates an example embodiment of a display for a user;

DETAILED DESCRIPTION

Figure 1:
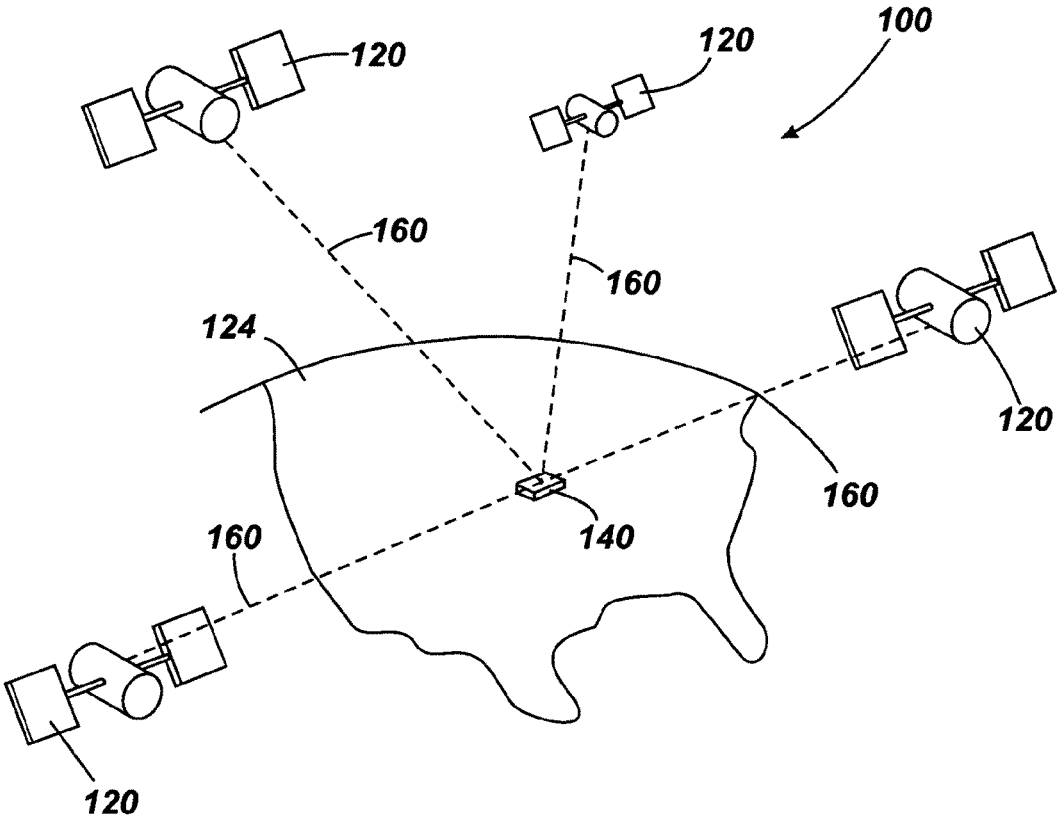
FIG. 1 illustrates a Global Positioning System (GPS)

Various example embodiments will now be described more fully with reference to the accompanying drawings in which some example embodiments are illustrated.

Accordingly, while example embodiments are capable of various modifications and alternative forms, embodiments thereof are shown by way of example in the drawings and will herein be described in detail. It should be understood, however, that there is no intent to limit example embodiments to the particular forms disclosed, but on the contrary, example embodiments are to cover all modifications, equivalents, and alternatives falling within the scope of example embodiments. Like numbers refer to like elements throughout the description of the figures.

It will be understood that, although the terms first, second, etc. may be used herein to describe various elements, these elements should not be limited by these terms. These terms are only used to distinguish one element from another. For example, a first element could be termed a second element, and, similarly, a second element could be termed a first element, without departing from the scope of example embodiments. As used herein, the term "and/or" includes any and all combinations of one or more of the associated listed items.

It will be understood that when an element is referred to as being "connected" or "coupled" to another element, it can be directly connected or coupled to the other element or intervening elements may be present. In contrast, when an element is referred to as being "directly connected" or "directly coupled" to another element, there are no intervening elements present. Other words used to describe the relationship between elements should be interpreted in a like fashion (e.g., "between" versus "directly between," "adjacent" versus "directly adjacent," etc.).

The terminology used herein is for the purpose of describing particular embodiments only and is not intended to be limiting of example embodiments. As used herein, the singular forms "a," "an" and "the" are intended to include the plural forms as well, unless the context clearly indicates otherwise. It will be further understood that the terms "comprises," "comprising," "includes" and/or "including," when used herein, specify the presence of stated features, integers, steps, operations, elements and/or components, but do not preclude the presence or addition of one or more other features, integers, steps, operations, elements, components and/or groups thereof.

Spatially relative terms, e.g., "beneath," "below," "lower," "above," "upper" and the like, may be used herein for ease of description to describe one element or a relationship between a feature and another element or feature as illustrated in the figures. It will be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, for example, the term "below" can encompass both an orientation which is above as well as below. The device may be otherwise oriented (rotated 90 degrees or viewed or referenced at other orientations) and the spatially relative descriptors used herein should be interpreted accordingly.

It should also be noted that in some alternative implementations, the functions/acts noted may occur out of the order noted in the figures. For example, two figures shown in succession may in fact be executed substantially concurrently or may sometimes be executed in the reverse order, depending upon the functionality/acts involved.

Unless otherwise defined, all terms (including technical and scientific terms) used herein have the same meaning as commonly understood by one of ordinary skill in the art to which example embodiments belong. It will be further understood that terms, e.g., those defined in commonly used dictionaries, should be interpreted as having a meaning that is consistent with their meaning in the context of the relevant art and will not be interpreted in an idealized or overly formal sense unless expressly so defined herein.

Portions of example embodiments and corresponding detailed description are presented in terms of software, or algorithms and symbolic representations of operation on data bits within a computer memory. These descriptions and representations are the ones by which those of ordinary skill in the art effectively convey the substance of their work to others of ordinary skill in the art. An algorithm, as the term is used here, and as it is used generally, is conceived to be a self-consistent sequence of steps leading to a desired result. The steps are those requiring physical manipulations of physical quantities. Usually, though not necessarily, these quantities take the form of optical, electrical, or magnetic signals capable of being stored, transferred, combined, compared, and otherwise manipulated. It is convenient at times, principally for reasons of common usage, to refer to these signals as bits, values, elements, symbols, characters, terms, numbers, or the like.

In the following description, illustrative embodiments will be described with reference to acts and symbolic representations of operations (e.g., in the form of flowcharts) that may be implemented as program modules or functional processes include routines, programs, objects, components, data structures, that perform particular tasks or implement particular abstract data types and may be implemented using existing hardware at existing network elements or control nodes (e.g., a database). Such existing hardware may include one or more Central Processing Units (CPUs), digital signal processors (DSPs), application-specific-integrated-circuits, field programmable gate arrays (FPGAs) computers or the like.

It should be borne in mind, however, that all of these and similar terms are to be associated with the appropriate physical quantities and are merely convenient labels applied to these quantities. Unless specifically stated otherwise, or as is apparent from the discussion, terms such as "processing" or "computing" or "calculating" or "determining" or "displaying" or the like, refer to the action and processes of a computer system, or similar electronic computing device, that manipulates and transforms data represented as physical, electronic quantities within the computer system's registers and memories into other data similarly represented as physical quantities within the computer system memories or registers or other such information storage, transmission or display devices.

Note also that the software implemented aspects of example embodiments are typically encoded on some form of computer readable medium or implemented over some type of transmission medium. The computer readable medium may be magnetic (e.g., a floppy disk or a hard drive) or optical (e.g., a compact disk read only memory, or "CD ROM"), and may be read only or random access. Similarly, the transmission medium may be twisted wire pairs, coaxial cable, optical fiber, or some other suitable transmission medium known to the art. Example embodiments are not limited by these aspects of any given implementation.

Example embodiments will now be described with particular reference to a portable navigation device (PND). It should be understood that the teachings of the present disclosure are not limited to PNDs and are universally applicable to any type of processing device that is configured to execute navigation software so as to provide route planning and navigation functionality. It follows therefore that in the context of the present application, a navigation device is intended to include (without limitation) any type of route planning and/or navigation device, irrespective of whether that device is embodied as a PND, a navigation device built into a vehicle, or indeed a computing resource (such as a desktop or portable personal computer (PC), mobile telephone or portable digital assistant (PDA) executing route planning and navigation software).

It will also be apparent from the following that the teachings of the present disclosure even have utility in circumstances where a user is not seeking instructions on how to navigate from one point to another, but merely wishes to be provided with a view of a given location. In such circumstances the "destination" location selected by the user need not have a corresponding start location from which the user wishes to start navigating, and as a consequence references herein to the "destination" location or indeed to a "destination" view should not be interpreted to mean that the generation of a route is essential, that travelling to the "destination" must occur, or indeed that the presence of a destination requires the designation of a corresponding start location.

Example embodiments provide for using historical sequential location measurements (e.g., GPS data) to analyze traffic and aid in road planning.

FIG. 1 illustrates an example view of Global Positioning System (GPS), usable by navigation devices, including a navigation device according to an example embodiment. Such systems are used for a variety of purposes. In general, GPS is a satellite-radio based navigation system capable of determining continuous position, velocity, time, and in some instances direction information for an unlimited number of users.

Formerly known as NAVSTAR, the GPS incorporates a plurality of satellites which work with the earth in extremely precise orbits. Based on these precise orbits, GPS satellites can relay their location to any number of receiving units.

The GPS system is implemented when a device, specially equipped to receive GPS data, begins scanning radio frequencies for GPS satellite signals. Upon receiving a radio signal from a GPS satellite, the device determines the precise location of that satellite via one of a plurality of different conventional methods. The device will continue scanning, in most instances, for signals until it has acquired at least three different satellite signals (noting that position can be determined, with only two signals using other triangulation techniques). When implementing geometric triangulation, the receiver utilizes the three known positions to determine an own two-dimensional position relative to the satellites. Determining the two-dimensional position can be done in a known manner. Additionally, acquiring a fourth satellite signal will allow the receiving device to calculate a three dimensional position of the receiver by the same geometrical calculation in a known manner. The position and velocity data can be updated in real time on a continuous basis by an unlimited number of users.

FIG. 1 illustrates a GPS system 100. A plurality of satellites 120 are in orbit about the earth 124. The orbit of each satellite 120 may not be synchronous with the orbits of other satellites 120 and, in fact, is likely asynchronous. A GPS receiver 140, usable in navigation devices according to example embodiments, is shown receiving spread spectrum GPS satellite signals 160 from the various satellites 120.

The spread spectrum signals 160 may be continuously transmitted from each satellite 120 to utilize a highly accurate frequency standard accomplished with an extremely accurate atomic clock. Each satellite 120, as part of its data signal transmission 160, transmits a data stream indicative of that particular satellite 120. It is appreciated by those skilled in the relevant art that the GPS receiver 140 generally acquires spread spectrum GPS satellite signals 160 from at least three satellites 120 for the GPS receiver 140 to calculate its two-dimensional position by triangulation. Acquisition of an additional signal, resulting in signals 160 from a total of four satellites 120, permits the GPS receiver 140 to calculate its three-dimensional position in a known manner.

Figure 2:
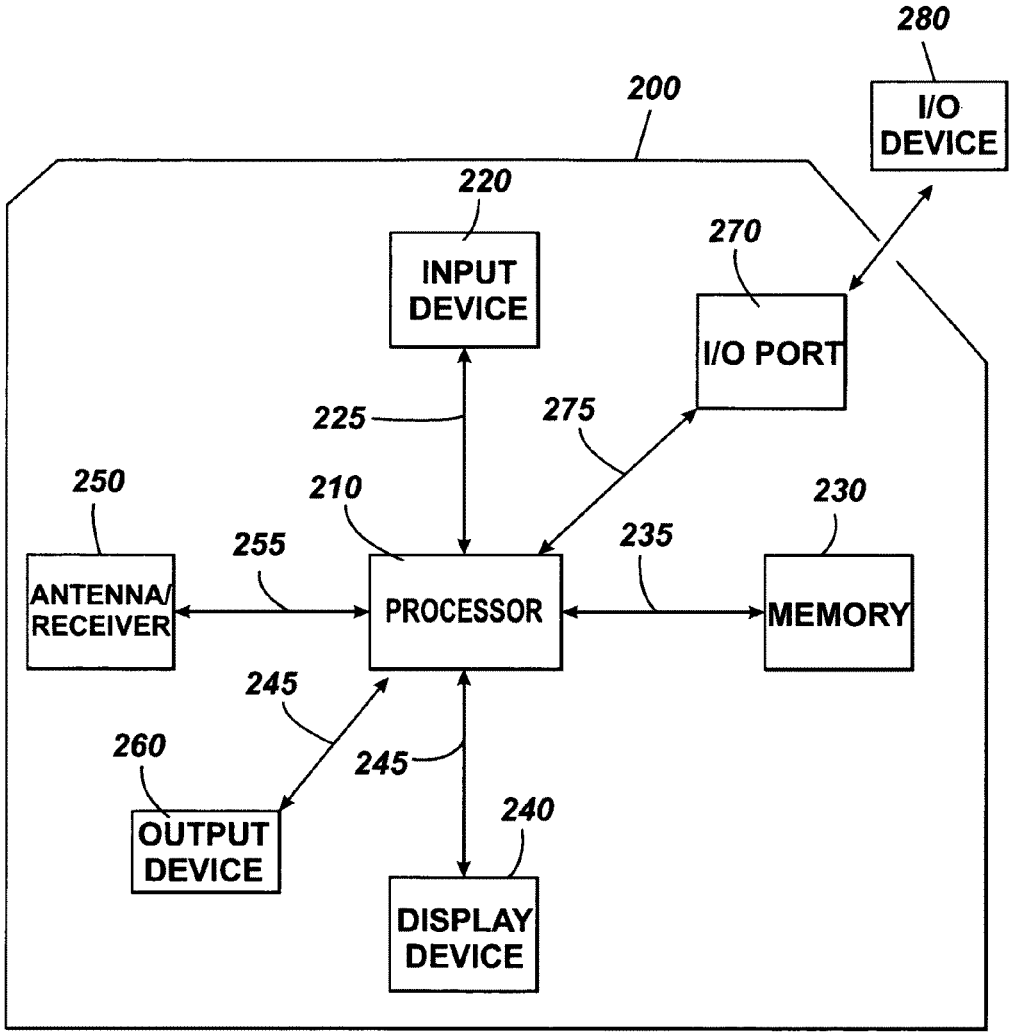
FIG. 2 illustrates a navigation device according to an example embodiment.

FIG. 2 illustrates a block diagram of a navigation device 200 according to an example embodiment. It should be noted that the block diagram of the navigation device 200 is not inclusive of all components of the navigation device, but is only representative of many example components.

The navigation device 200 includes a processor 210 connected to an input device 220 and a display screen 240. The input device 220 may include a keyboard device, voice input device, and/or any other known input device utilized to input information; and the display screen 240 can include any type of display screen such as an LCD display, for example. In at least one example embodiment, the input device 220 and the display screen 240 are integrated into an integrated input and display device, including a touchpad or touchscreen input wherein a user need only touch a portion of the display screen 240 to select one of a plurality of display choices or to activate one of a plurality of virtual buttons.

The navigation device may include an output device 260, for example, an audible output device (e.g., a loudspeaker). As the output device 260 can produce audible information for a user of the navigation device 200, it is should equally be understood that the input device 220 can include a microphone and software for receiving input voice commands as well.

In the navigation device 200, the processor 210 is operatively connected to and set to receive input information from input device 240 via a connection 225, and operatively connected to at least one of the display screen 240 and the output device 250, via output connections 245, to output information thereto. Further, the processor 210 is operatively connected to the memory 230 via the connection 235 and is further adapted to receive/send information from/to input/output (I/O) ports 270 via a connection 275, wherein the I/O port 270 is connectible to an I/O device 280 external to the navigation device 200.

The external I/O device 280 may include, but is not limited to an external listening device such as an earpiece. For example, the connection to the I/O device 280 can further be a wired or wireless connection to any other external device such as a car stereo unit for hands-free operation and/or for voice activated operation, for connection to an ear piece or head phones, and/or for connection to a mobile phone. Moreover, the mobile phone connection may be used to establish a TCP/IP connection between the navigation device 200 and the internet or any other network, and/or to establish a connection to a server via the internet or some other network.

FIG. 2 further illustrates an operative connection between the processor 210 and an antenna/receiver 250 via a connection 255. The antenna/receiver 250 can be a GPS antenna/receiver, for example. It will be understood that the antenna and receiver designated by reference numeral 250 are combined schematically for illustration, but that the antenna and receiver may be separately located components, and that the antenna may be a GPS patch antenna or helical antenna for example.

Further, it will be understood by one of ordinary skill in the art that the electronic components shown in FIG. 2 are powered by power sources (not shown) in a conventional manner. As will be understood by one of ordinary skill in the art, different configurations of the components shown in FIG. 2 are considered within the scope of example embodiments. For example, in one embodiment, the components shown in FIG. 2 may be in communication with one another via wired and/or wireless connections and the like. Thus, the scope of the navigation device 200 includes a portable or handheld navigation device 200.

In addition, the portable or handheld navigation device 200 of FIG. 2 can be connected or "docked" in a known manner to a motorized vehicle such as a car or boat, for example. Such a navigation device 200 is then removable from the docked location for portable or handheld navigation use.

Figure 3:
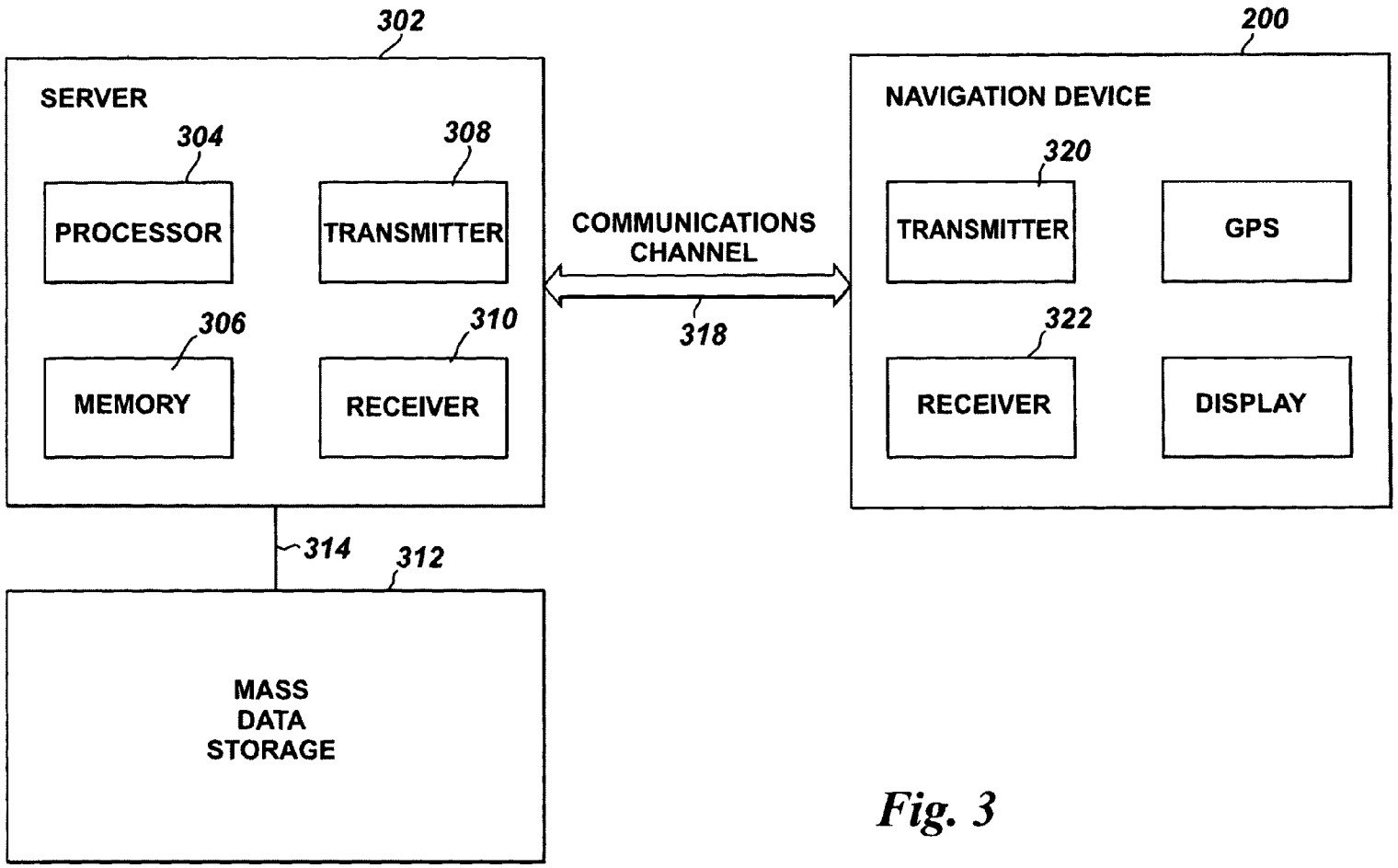
FIG. 3 illustrates manner in which a navigation device may receive information over a wireless communications channel, according to an example embodiment.

Referring now to FIG. 3, the navigation device 200 may establish a "mobile" or telecommunications network connection with a server 302 via a mobile device (not shown) (such as a mobile phone, PDA, and/or any device with mobile phone technology) establishing a digital connection (such as a digital connection via known Bluetooth technology). Thereafter, through its network service provider, the mobile device can establish a network connection (through the internet for example) with the server 302. As such, the "mobile" network connection is established between the navigation device 200 (which can be, and often times is mobile as it travels alone and/or in a vehicle) and the server 302 to provide a "real-time" or at least very "up to date" gateway for information.

The establishing of the network connection between the mobile device (via a service provider) and another device such as the server 302, using the Internet (such as the World Wide Web), for example, can be done in a known manner. This can include use of a TCP/IP layered protocol, for example. The mobile device can utilize any number of communication standards such as CDMA, GSM and WAN.

As such, an internet connection may be utilized which is achieved via data connection, via a mobile phone or mobile phone technology within the navigation device 200, for example. For this connection, the internet connection between the server 302 and the navigation device 200 is established. This can be done, for example, through a mobile phone or other mobile device and a GPRS (General Packet Radio Service)-connection. GPRS connection is a high-speed data connection for mobile devices provided by telecom operators; GPRS is a method to connect to the internet.

The navigation device 200 can further complete a data connection with the mobile device, and eventually with the internet and server 302, via existing Bluetooth technology, for example, in a known manner, wherein the data protocol can utilize any number of standards, such as the GSRM, the Data Protocol Standard for the GSM standard, for example.

The navigation device 200 may include its own mobile phone technology within the navigation device 200 (including an internal antenna, of the navigation device 200, for example). The mobile phone technology within the navigation device 200 can include internal components as specified above, and/or can include an insertable card (e.g. Subscriber Identity Module or SIM card), complete with necessary mobile phone technology and/or an antenna, for example. As such, mobile phone technology within the navigation device 200 can similarly establish a network connection between the navigation device 200 and the server 302, via the Internet for example, in a manner similar to that of any mobile device.

For GPRS phone settings, a Bluetooth enabled navigation device may be used to correctly work with the ever changing spectrum of mobile phone models and manufacturers. Model/manufacturer specific settings may be stored on the navigation device 200, for example. The data stored for this information can be updated.

In FIG. 3, the navigation device 200 is depicted as being in communication with the server 302 via a generic communications channel 318 that can be implemented by any of a number of different arrangements. The server 302 and navigation device 200 can communicate when a connection via communications channel 318 is established between the server 302 and the navigation device 200 (noting that such a connection can be a data connection via mobile device and a direct connection via personal computer via the Internet).

The server 302 includes, in addition to other components which may not be illustrated, a processor 304 operatively connected to a memory 306 and further operatively connected, via a wired or wireless connection 314, to a mass data storage device. The processor 304 is further operatively connected to a transmitter 308 and a receiver 310, to transmit and send information to and from navigation device 200 via communications channel 318, respectively. The signals sent and received may include data, communication, and/or other propagated signals. The transmitter 308 and receiver 310 may be selected and/or designed according to a communications requirement and communication technology used in the communication design for the navigation system 200. Further, it should be noted that the functions of the transmitter 308 and receiver 310 may be combined into a signal transceiver.

The server 302 is further connected to (or includes) the mass storage device 312. The mass storage device 312 may be coupled to the server 302 via communication link 314. The mass storage device 312 contains a store of navigation data and map information, and can again be a separate device from the server 302 or can be incorporated into the server 302.

The navigation device 200 is adapted to communicate with the server 302 through a communications channel 318, and includes the processor 210 and the memory 230, as previously described with regard to FIG. 2, as well as the transmitter 320 and receiver 322 to send and receive signals and/or data through the communications channel 318, noting that these devices can further be used to communicate with devices other than server 302. Further, the transmitter 320 and receiver 322 are selected or designed according to communication requirements and communication technology used in the communication design for the navigation device 200 and the functions of the transmitter 320 and receiver 322 may be combined into a single transceiver.

Software stored in the memory 306 provides instructions for the processor 304 and allows the server 302 to provide services to the navigation device 200. One service provided by the server 302 involves processing requests from the navigation device 200 and transmitting navigation data from the mass data storage 312 to the navigation device 200. Another service provided by the server 302 includes processing the navigation data using various algorithms for a desired application and sending the results of these calculations to the navigation device 200.

The communications channel 318 generically represents a propagating medium or path that connects the navigation device 200 and the server 302. Both the server 302 and navigation device 200 include transmitters 308, 320 for transmitting data through the communication channel 318 and receivers 310, 322 for receiving data that has been transmitted through the communications channel 318.

The communications channel 318 is not limited to a particular communication technology. Additionally, the communications channel 318 is not limited to a single communication technology. The communication channel 318 may include several communication links that use a variety of technologies. For example, the communications channel 318 can be adapted to provide a path for electrical, optical, and/or electromagnetic communications. As such, the communications channel 318 includes, but is not limited to, one or a combination of the following: electric circuits, electrical conductors such as wires and coaxial cables, fiber optic cables, converters, radio-frequency (RF) waves, the atmosphere and empty space. Furthermore, the communications channel 318 can include intermediate devices such as routers, repeaters, buffers, transmitters, and receivers.

In an example embodiment, the communications channel 318 includes telephone and computer networks. Furthermore, the communications channel 318 may be capable of accommodating wireless communications such as radio frequency, microwave frequency, and infrared communication. Additionally, the communications channel 318 can accommodate satellite communication.

The communications signals transmitted through the communications channel 318 include, but are not limited to, signals as may be required or desired for given communication technology. For example, the signals may be adapted to be used in cellular communication technology such as Time Division Multiple Access (TDMA), Frequency Division Multiple Access (FDMA), Code Division Multiple Access (CDMA) and Global System for Mobile Communications (GSM). Both digital and analogue signals can be transmitted through the communication channel 318. These signals may be modulated, encrypted and/or compressed signals as may be desirable for the communication technology.

The server 302 is a remote server accessible by the navigation device 200 via a wireless channel. The server 302 may include a network server located on a local area network (LAN), wide area network (WAN) and/or virtual private network (VPN).

The server 302 may include a personal computer such as a desktop or laptop computer, and the communications channel 318 may be a cable connected between the personal computer and the navigation device 200. Alternatively, a personal computer may be connected between the navigation device 200 and the server 302 to establish an internet connection between the server 302 and the navigation device 200. Alternatively, a mobile telephone or other handheld device may establish a wireless connection to the internet, for connecting the navigation device 200 to the server 302 via the internet.

The navigation device 200 may be provided with information from the server 302 via information downloads which may be periodically updated automatically or upon a user connecting navigation device 200 to the server 302 and/or may be more dynamic upon a more constant or frequent connection being made between the server 302 and navigation device 200 via a wireless mobile connection device and TCP/IP connection, for example. For many dynamic calculations, the processor 304 in the server 302 may be used to handle the bulk of the processing; however, processor 210 of navigation device 200 can also handle much processing and calculation, oftentimes independent of a connection to a server 302.

As indicated above in FIG. 2, a navigation device 200 includes the processor 210, the input device 220, and the display screen 240. The input device 220 and display screen 240 are integrated into an integrated input and display device to enable both input of information (via direct input, menu selection) and display of information through a touch panel screen, for example. Such a screen may be a touch input LCD screen, for example, as is well known to those of ordinary skill in the art. Further, the navigation device 200 can also include any additional input device 220 and/or any additional output device 241, such as audio input/output devices, for example.

Figure 4A:
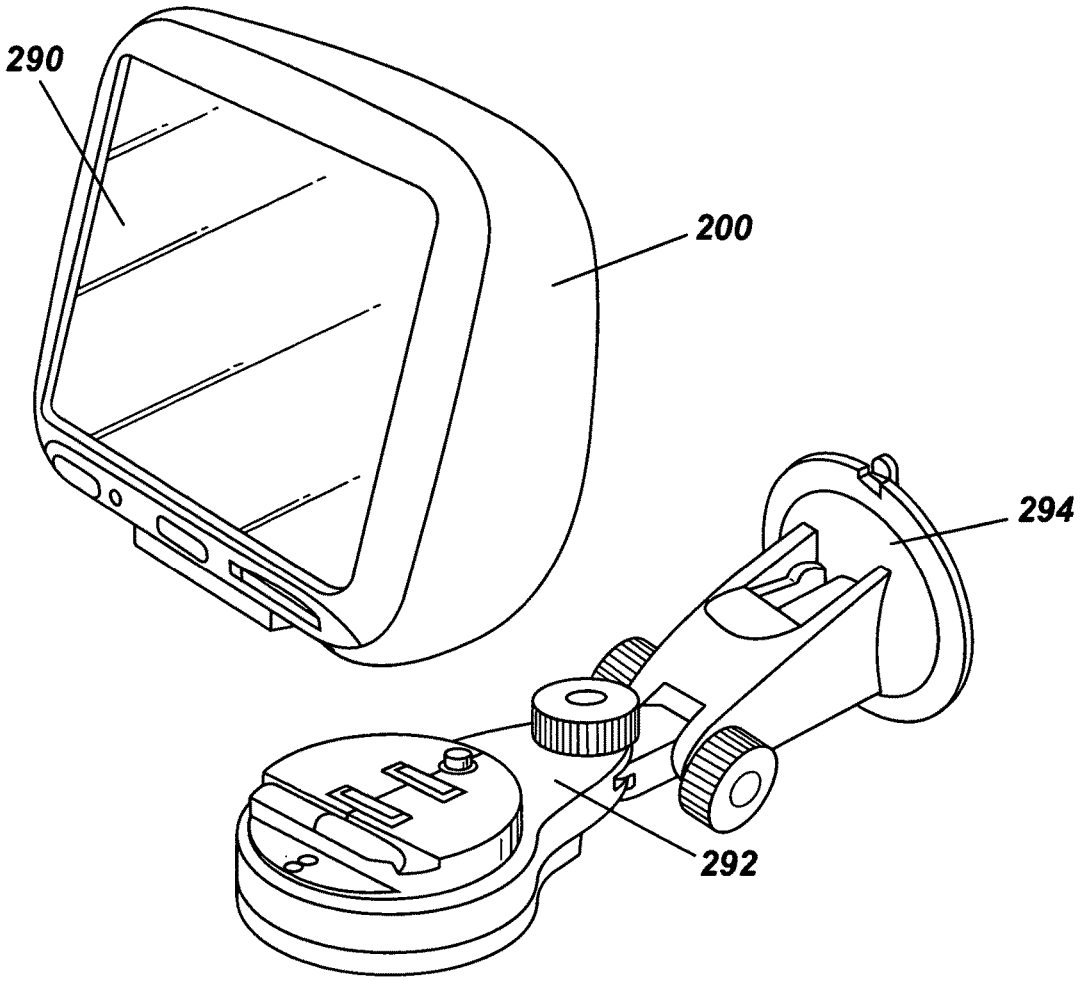
FIGS. 4*a* and 4*b* illustrate perspective views of the navigation device of FIG. 2.
Figure 4B:
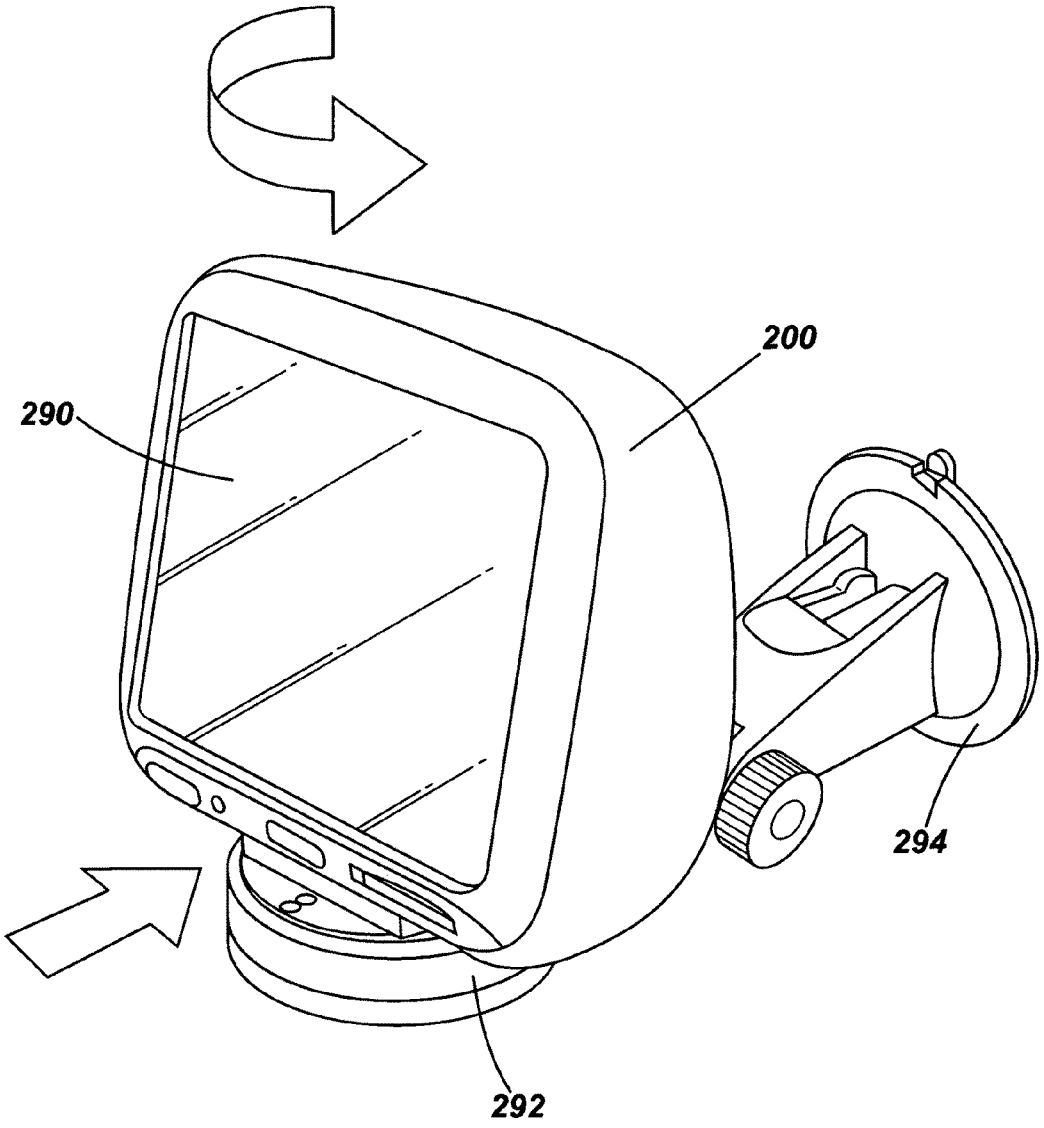

FIGS. 4*a* and 4*b* are perspective views of the navigation device 200. As shown in FIG. 4*a*, the navigation device 200 may be a unit that includes an integrated input and display device 290 (a touch panel screen, for example) and the other components of FIG. 2 (including but not limited to internal GPS receiver 250, microprocessor 210, a power supply, memory systems 230, etc.).

The navigation device 200 may sit on an arm 292, which itself may be secured to a vehicle dashboard/window/etc. using a suction cup 294. This arm 292 is one example of a docking station to which the navigation device 200 can be docked.

As shown in FIG. 4*b*, the navigation device 200 can be docked or otherwise connected to an arm 292 of the docking station by snap connecting the navigation device 200 to the arm 292, for example. The navigation device 200 may then be rotatable on the arm 292, as shown by the arrow of FIG. 4*b*. To release the connection between the navigation device 200 and the docking station, a button on the navigation device 200 may be pressed, for example. Other equally suitable arrangements for coupling and decoupling the navigation device to a docking station are well known to persons of ordinary skill in the art.

FIGS. 5-11E and 12B illustrate example embodiments of using a historical data stored in a storage database for traffic analysis and planning.

In at least one example embodiment, a method of analyzing traffic includes receiving sequential location measurements from users of a system, mapping the received sequential location measurements to a digital map and determining traffic information for a first time period based on mapped sequential location measurements corresponding to the first period. The example embodiments described below use GPS data as an example of sequential location measurements, however, the example embodiments should not be limited thereto.

Segments in navigation networks, such as a portion of a road and/or a sidewalk are often referred to as navigable features. Boundaries of these segments, such as centrelines, lanes, curbs, shoulder lines and stop sign lines may be referred to as geometric features.

Moreover, while example embodiments described below utilize GPS measurements (trace points) including latitudinal and longitudinal coordinates as location measurements, it should be understood that location measurements may be obtained from any source and are not limited to GPS.

Traffic information may include (1) travel times on a road network; (2) speeds on the road network; (3) an overview of the most used road segments in the road network; (4) an overview of traffic bottleneck in the road network; (5) which routes are used to travel between a specific origin and destination; (6) flows of traffic between geographic areas; (7) flows of traffic over complex intersections; (8) measured speeds (from a storage database) being provided in a display of what speeds traffic moved at on a road on what days and times; and (9) differences in speeds between peak and off-peak time periods displayed by road segment.

Figure 5:
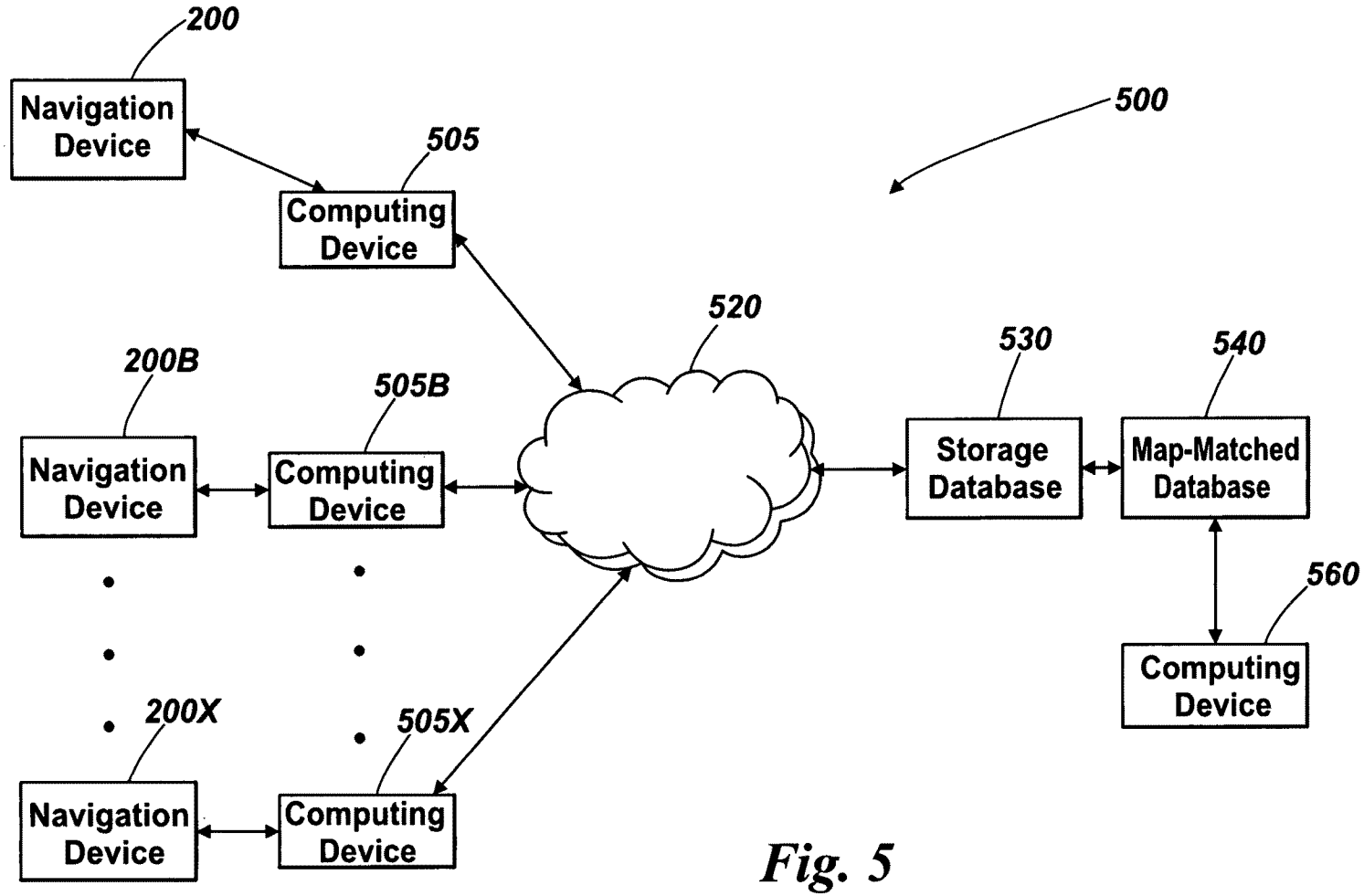
FIG. 5 illustrates a system for analyzing traffic and planning according to an example embodiment.

FIG. 5 illustrates a system for analyzing traffic and planning according to an example embodiment. More specifically, FIG. 5 illustrates a system 500 including a storage database 530 configured to store sequential location measurements (e.g., GPS data) received from of users of the system 500. The GPS data includes periodic times and associated coordinates of each user of the system 500. The GPS data are transferred between the storage database 530 and the map-matched database 540. A processor (e.g., 547) in a map-matched database 540 is configured to extract GPS data from the map-matched database 540 and determine traffic information for a first period based on the extracted GPS data. The extracted GPS data are historical GPS data and, therefore, correspond to a previous second period. For example, traffic information for a future date of Jan. 1, 2011 may be determined based on the GPS data that corresponds to Jan. 1, 2010, Jan. 1, 2009 and other January 1 of previous years.

The system 500 further includes the navigation device 200 and navigation devices 200B-200X connected to the storage database 530 through the Internet 520. Although FIG. 5 illustrates only three navigation devices 200, 200B-200X, they are only representative for illustration and the example embodiments are not limited as such.

The navigation devices 200, 200B-200X are connected to the Internet 520 by computing devices 505, 505B-505X, respectively. The navigation devices 200B-200X may have the same circuit and hardware design of the navigation device 200 and, therefore, may perform the same functions that the navigation device 200 may perform. Alternatively, the navigation devices 200B-200X may be a navigation device that is known and is different from the navigation device 200.

The navigation devices 200, 200B-200X may be connected to the computing devices 505, 505B-505X in a known manner such as a USB (Universal Serial Bus) cord. The computing devices 505, 505B-505X are connected to the Internet 520 through connections 510, 510B-510X. The establishing of a connection between the navigation devices 200, 200B-200X and the storage database 530 using the Internet 520 may be done in a known manner.

In the example embodiment, the establishment of a connection between the storage database 530 and at least one of the navigation devices 200, 200B-200X can be used to send information acquired by the navigation devices 200, 200B-200X to the storage database 530.

For the sake of clarity and brevity, the description of the navigation device 200 and the computing device 505 will be described. However, it should be understood that the navigation devices 200B-200X may have the same functionality of the navigation device 200 and the computing devices 505B-505X may have the same functionality of the computing device 505. Therefore, for the sake of clarity and brevity, a detailed description of the navigation devices 200B-200X and the computing devices 505B-505X will not be discussed.

The navigation device 200 is configured to acquire data. The acquired data are GPS data (GPS registrations) which include time and latitudinal and longitudinal coordinates of the navigation device 200. To acquire data, a user of the navigation device 200 is asked whether the user is willing to provide data. If the user agrees to provide data, then the navigation device periodically acquires the data such as time and coordinates. The time includes the time of day and the coordinates that identify the location of the navigation device 200.

The navigation device 200 acquires the data periodically. For example, the navigation device 200 may acquire GPS data every 10 seconds. The GPS data are written to the memory 230 of the navigation device 200. The GPS data form a data set covering paths (e.g., roads) that have been covered by the navigation device 200 with dates, times and coordinates. Thus, velocities may be calculated from the GPS data since coordinates and times are known.

The GPS data are stored in an archive file in the memory 230 of the navigation device as anonymous data. The archive file may be accessed from the computing device 505.

The computing device 505 may be a personal computer, mobile phone, PDA or any type of device that is configured to upload the archive file stored in the memory 230 to the storage database 530 through the Internet 520 when connected to the navigation device 200. If the computing device 505 is a mobile device, the mobile computing device can utilize any number of communication standards such as CDMA, GSM and WAN.

The storage database 530 stores the anonymous archive files that are downloaded from the various navigation devices 200, 200B-200X. Therefore, the storage database 530 stores numerous measurements regarding the paths that the navigations devices 200, 200B-200X have covered.

The map-matched database 540 is operatively coupled to the storage database 530. The map-matched database 540 is configured to map the GPS data to a digital map. The storage database 530 and the map-matched database 540 may be implemented in the server 302 and/or the mass storage device 312, for example.

The map-matched database 540 is operatively coupled to a computing device 560. Based on various request criteria, such as day, time of day, originating location and destination, a processor and software of the map-matched database may provide traffic information to a user of the computing device 560. While the computing device 560 is illustrated as a separate entity from the computing devices 505, 505B-505X, it should not be limited thereto.

Figure 6:
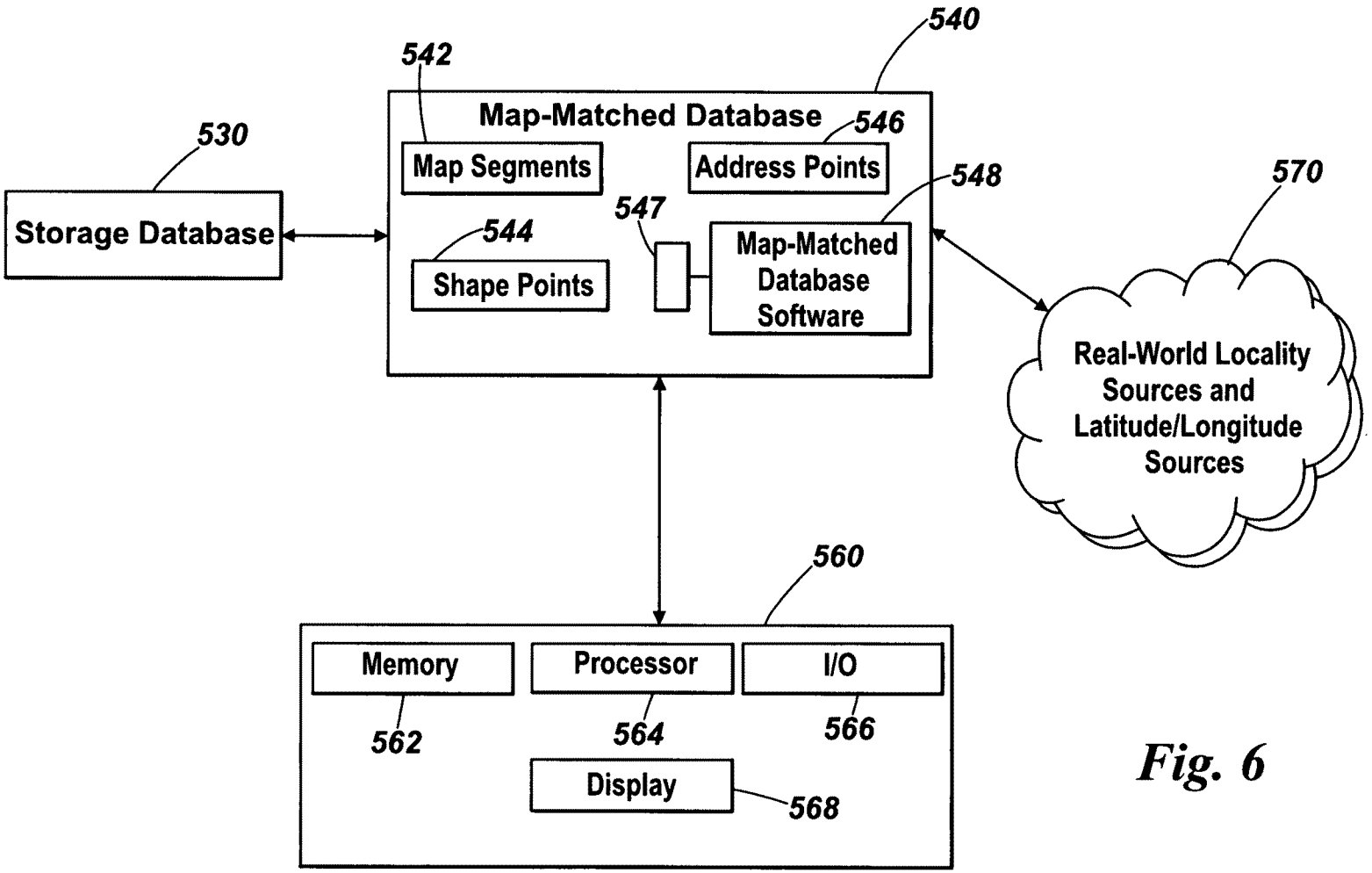
FIG. 6 illustrates the map-matched database and the computing device of FIG. 5 according to an example embodiment.

FIG. 6 illustrates the map-matched database 540 and the computing device 560 according to an example embodiment. Although FIG. 6 depicts components as logically separate, such depiction is merely for illustrative purposes. It will be apparent to those skilled in the art that the components portrayed in this figure can be combined or divided into separate software, firmware and/or hardware components. Furthermore, it will also be apparent to those skilled in the art that such components, can be executed on the same computing device/system or can be distributed among different computing devices/systems connected by one or more networks or other suitable communication means.

As shown in FIG. 6, the computing device 560 includes a memory 562, a processor 564, and I/O 566 and a display 568. The display 568 may display maps and other information to a user of the computing device 560.

The map-matched database 540 is shown as external storage to the computing device 560, but the map-matched database 540 in some instances may be the same memory as memory 562. The map-matched database 540 includes map segments 542 of digital maps, shape points 544, address points 546 and a processor 547 configured to run proprietary map-matched database software 548. The processor 547 may be the processor 304 and, therefore, has the same functionality as the processor 304.

Moreover, while the processor 547 is shown as internal to the map-matched database 540, the processor may be external to the map-matched database 540.

The map-matched database software 548 (computer software) includes one or more software modules operable, when executed in an execution environment, to cause the processor 547 to connect to the map-matched database 540 that is configured to store sequential location measurements received from users of the system, the sequential location measurements including periodic times and associated coordinates, and extract sequential location measurements from the storage database 540 and determine traffic information for a first period based on the extracted sequential location measurements.

The map-matched database software 548 uses real-world locality sources and latitude/longitude sources 570 to create the map segments 542, shape points 544 and address points 546 in the map-matched database 540.

The map-matched database 540 includes GPS data that is matched to the map segments 542 in the digital maps. The matched GPS data is then mapped GPS data. Methods of map-matching are well know and, therefore, will not be described in greater detail for the sake of clarity and brevity.

The map-matched database 540 is configured to perform data mining on the mapped GPS data using the processor 547 with the map-matched database software 548. The data mining utilizes slices. For one map segment comparison, a slice is formed of a map segment and time frame. The time frame can be any form. A map segment may be referred to as the smallest 2-dimensional unit in the underlying map implementation. For inter-segment comparisons, a slice is formed by a collection of map segments. All mapped GPS data along the slice are processed and accumulated. The GPS data of all map segments are then accumulated. The GPS data is processed per segment to increase coverage.

The data mining allows the map-matched database 540 to extract mapped GPS data based on the associated coordinates and times of the GPS data. The mapped GPS data may be stored on a per day level. If a user requests traffic information for a time period smaller than a day, further filtering is applied to obtain the mapped GPS data corresponding to the time period.

Using the computing device 560, a user may access the map-matched database 540 for traffic analysis and planning. A user may be governmental official(s), commercial customers or any user who travels the road network. The map-matched database 540 uses actual calculated speeds from the GPS data to analyze traffic rather than theoretical speeds (e.g., speed limits). For example, a user uses the computing device 560 to request an estimated travel time for Jan. 1, 2011 from a first origin to a first destination (e.g., a user-specified route). The map-matched database software 548 of the map-matched database 540 receives the request and instructs the processor 547 to extract GPS data that are digitally mapped that correspond to January 1 of previous years (historical data) and are for coordinates on the user specified route on the road network. The map-matched database 540 then uses the extracted GPS data to calculate the estimated travel time and speeds. More specifically, the map-matched database compares the times of the extracted mapped GPS data across roads in the map to calculate the estimated travel time and speeds.

Estimated travel time is just one example of traffic information. Other examples of traffic information include: (1) origin(A)-destination(B) flow patterns, which are the percentages of users that travel along various routes from A to B; (2) origin(A)-destination(B) route patterns, which are routes used between A and B; (3) isochronal maps, which are bands of travel times around specific locations illustrating accessibility, by day and time of day; (4) selected link origin-destination flow patterns, which indicate where traffic is coming and going on a route; (5) rat runs, which is how much undesirable traffic is cutting through a center of town, compared to total traffic flows (e.g., traffic using a small residential street as a through-route, when the traffic should be using a bypass or major thoroughfare); (6) bottleneck analysis, which is based on measured speeds on the roads and indicates where traffic is slow by day and time of day; (7) intersection analysis, which indicates the relative flows of traffic between different legs of an intersection; (8) measured speeds (from a storage database) being provided in a display of what speeds traffic moved at on a road on what days and times; and (9) differences in speeds between peak and off-peak time periods displayed by road segment.

The above also applies to a method of an example embodiment. The method includes receiving GPS data by the storage database from users of the navigations devices 200, 200B-200X, mapping the received GPS data to a digital map in the map-matched database 540 and determining traffic information for a first time period based on the mapped GPS data during a previous second period. For example, traffic information for a future date of Jan. 1, 2011 may be determined based on the GPS data that corresponds to Jan. 1, 2010, Jan. 1, 2009 and other January 1 of previous years.

Since the map-matched database 540 acquires data from navigation devices that travel paths and roads, the cost of traffic analysis is reduced because the acquired data may replace costly camera systems, inductive loops and other traffic measuring systems. Furthermore, as described in more detail below, the navigation devices provide more precise measurements than the costly devices, thereby improving traffic analysis and planning.

Figure 7:
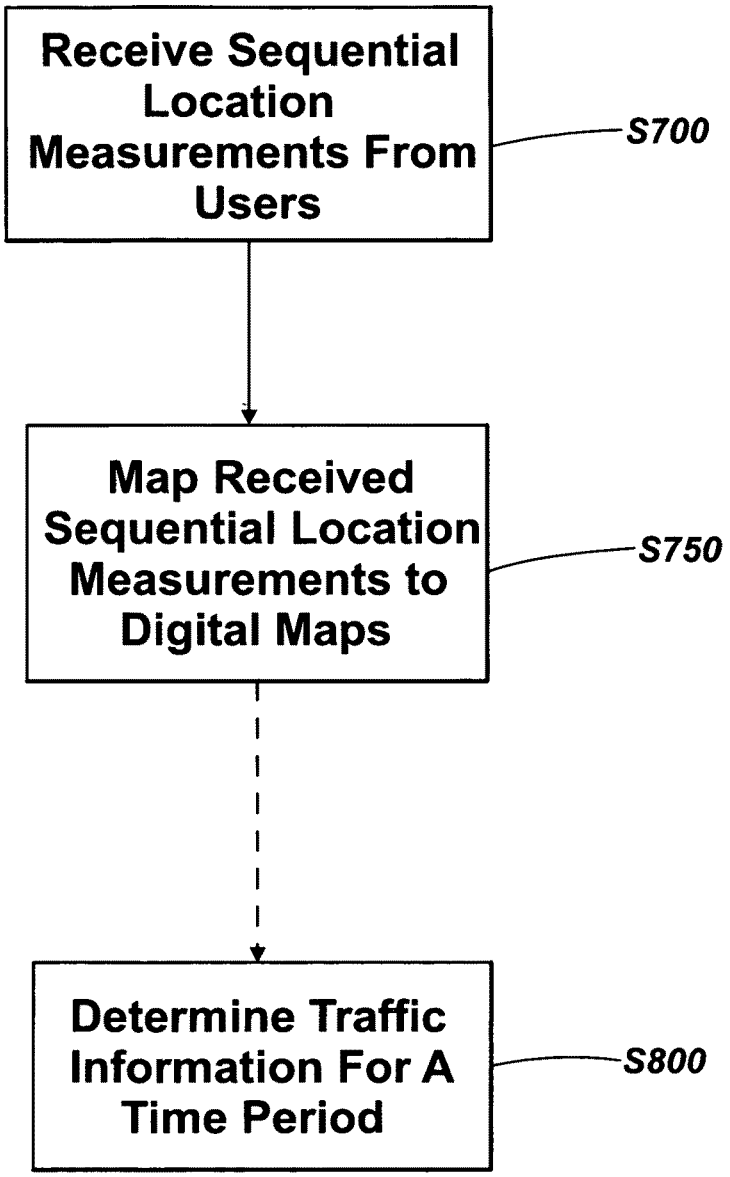
FIG. 7 illustrates a method of analyzing traffic by a system according to an example embodiment.

FIG. 7 illustrates a method of analyzing traffic by a system according to an example embodiment. The method includes receiving sequential location measurements (GPS data) from users of the system, mapping the received sequential location measurements to a digital map and determining traffic information for a first time period based on mapped sequential location measurements corresponding to the first time period. The method of FIG. 7 may be performed by the system 500, but should not be limited thereto.

As shown in FIG. 7, sequential location measurements (GPS data) are received from users of the system at S700. Here, GPS data is used as an example of sequential location measurements, but the example embodiments should not be limited thereto. The GPS data may be received from the storage database 530 and therefore, the storage database described with reference to FIG. 7 may have the same functionality of the storage database 530. The users of the system are users of navigation devices such as the navigation device 200. The navigation device as described in FIG. 7 may have the same functionality of the navigation device 200. The navigation device collects GPS data including day, time and latitudinal and longitudinal coordinates when it is turned on. When the navigation device is connected to a computing device configured to upload information to the storage database, the computing device uploads archive files to the storage database. The archive files include the GPS data.

At S750, the received GPS data (sequential location measurements) are mapped to a digital map by a map-matched database. The map-matched database of FIG. 7 may be the map-matched database 540 and, therefore, the map-matched database described with reference to FIG. 7 may have the same functionality of the map-matched database 540. The associated coordinates of the GPS data are defined by an element identification in the map-matched database and matched to map segments in the digital maps of the map-matched database.

At S800, the processor and map-matched software of the map-matched database may determine traffic information for a time period.

Figure 8:
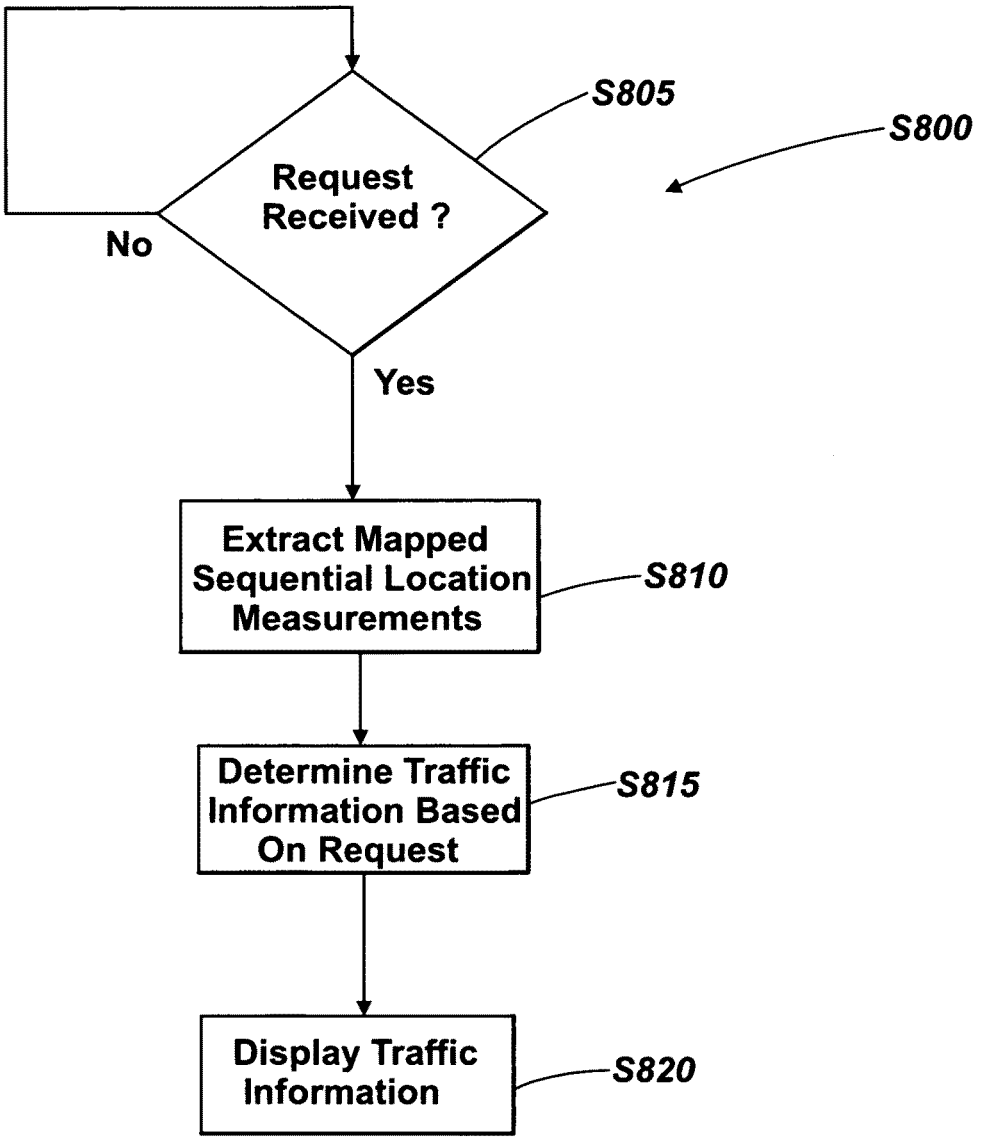
FIG. 8 illustrates an example embodiment of determining traffic information.

FIG. 8 illustrates an example embodiment of S800. At S805, the map-matched database determines whether a request for traffic information has been received. The analysis may be requested from a user of a computing device. The computing device described in FIG. 8 may be the computing device 560 and, therefore, the computing device described with reference to FIG. 8 may have the same functionality of the computing device 560.

The request may include a type of traffic information requested, origin, destination and a time period. The time period may be for just a certain time of day. For example, a user may request any type of traffic information described above such as bottleneck analysis from 3 p.p. to 7 p.m. from the Amsterdam Centraal railway station to the Vondelpark in Amsterdam on Jan. 1, 2011.

A processor with map-matched database software in the map-matched database is configured to receive the request and process the request from the user. The processor and the map-matched database software described in FIG. 8 may be the processor 547 and the map-matched database software 548 and, therefore, the processor and the map-matched database software described with reference to FIG. 8 may have the same functionality of the processor 547 and the map-matched database software 548.

If a request is received at S805, the processor processes the request which includes extracting mapped GPS data that correspond to the type of traffic information requested and the time. The mapped GPS data is extracted by data mining the GPS data based on the associated coordinates and times of the GPS data. For example, if a user requests a bottleneck analysis from 3 p.m. to 7 p.m. from the Amsterdam Centraal railway station to the Vondelpark in Amsterdam on Jan. 1, 2011, the map-matched database software selects all segments needed to travel from the railway station to Vondelpark. The map-matched database extracts all mapped GPS data on each selected segment on Jan. 1, 2010, Jan. 1, 2009 and previous January 1 from 3 p.m. to 7 p.m. and, based on a transit time distribution per segment, derives a global transit time. In a case where multiple routes between the railway and Vondelpark, each route may be analyzed individually.

Once the map-matched database software extracts the mapped GPS data that corresponds to the request, the map-matched database determines the traffic information based on the request at S815. Based on the amount of GPS data (number of GPS registrations), associated coordinates, time of year, time of day and speed, the map-matched database may provide the following types of traffic information:

(1) origin(A)-destination(B) flow patterns;

(2) origin(A)-destination(B) route patterns;

(3) isochronal maps;

(4) selected link origin-destination flow patterns;

(5) rat runs;

(6) bottleneck analysis;

(7) intersection analysis;

(8) measured speeds (from a storage database) being provided in a display of what speeds traffic moved at on a road on what days and times; and (9) differences in speeds between peak and off-peak time periods displayed by road segment.

Origin(A)-destination(B) flow patterns, origin(A)-destination(B) route patterns, and selected link origin-destination flow patterns are variants of the same algorithm. The algorithm first extracts all sequential location measurements (e.g., GPS data) touching the selected areas (origin and destination or selected segment). Then, the extracted sequential location measurements are broken up into continuous pieces (stop detection). Break up criterion is used to break the sequential location measurements into the pieces. If there is no GPS data for time period, the location measurements are broken into pieces at that time period. The time period may fifteen minutes and may be configurable. A start and an end of the pieces constitute the result for origin(A)-destination(B) flow patterns and selected link origin-destination flow patterns. Segments constitute the result for origin(A)-destination(B) route patterns.

Isochronal maps are based on a Dijkstra algorithm using dynamic speed profiles.

For bottleneck analysis, the processor calculates histogram transit times per segment and time interval and then accumulates the transit times to a global transit time histogram. Both, transit time on segment base and global transit time pinpoint the existence of bottlenecks and location. The algorithm uses a set of segments and a set of time definitions (any time frame, like Monday mornings). The processor then calculates average (median) speeds for all time definitions and segments (the processor collects all GPS data on that segment in that time and calculates average/median). A bottleneck during one time frame is a segment with a significantly lower speed than all others. A bottleneck along a segment is a time definition with significantly lower speed than all other time definitions. To find such bottlenecks the low percentiles of the speed distribution are compared to the median.

An intersection analysis is an origin/destination analysis, where the origins are the segments entering the intersection and the destinations are the segments leaving the intersection.

For the display of what speeds traffic moved at on a road on what days and time and differences in speeds between peak and off-peak time periods by road segments, all GPS data of all segments along the road and the specified time frame is accumulated to a single value (average, percentile) or a set of values (percentile histogram). Afterwards, a visualization of the route is drawn using the calculated values. The values can be visualized by color (heat map), height, or width. For differences in speeds between peak and off-peak time period, the visualized value is the ratio between two runs on the same segment.

Once the map-matched software has determined the traffic information requested, the requested traffic information is displayed at S820. The traffic information may be displayed on the computing device for the user. More specifically, the traffic information may be displayed on the display 568. It should also be understood that the computing device may be part of the map-matched database and, therefore, the traffic information may be displayed at the map-matched database.

For a rat run, the processor takes two areas and a time definition. The processor then finds all location measurements groups touching both areas. For all these groups, the groups are split into consecutive parts (stop detection). For each part, if the part is completely in a defined time frame and touches a first area before a second area (time-wise), all segments used by that part will be marked as used. Usage is an accumulative mark, that is, if a segment is used several times, the mark indicates the number of usage. The most heavily used segments are found by looking at the usage distribution.

As described above, the method of FIGS. 7 and 8 use actual speed measurements rather than theoretical (e.g., speed limits) numbers to provide a more accurate analysis of traffic.

FIGS. 9A-11E illustrate various example embodiments of the determined traffic information and the displays thereof.

FIG. 9A illustrates a display of results obtained from a user's request for traffic information. FIG. 9A illustrates a display 900 where a user requests a report of travel times for different time periods of the day. As shown, the user requests an origin 905 and a destination 910. Implementing the method described above, the processor extracts mapped GPS data corresponding to the route selected and a.m. peak, p.m. peak and off peak times. The processor determines the requested traffic information for display. As shown the travel times for a.m. peak, p.m. peak and off peak times are 42 minutes, 44 minutes and 34 minutes, respectively.

Figure 9B:
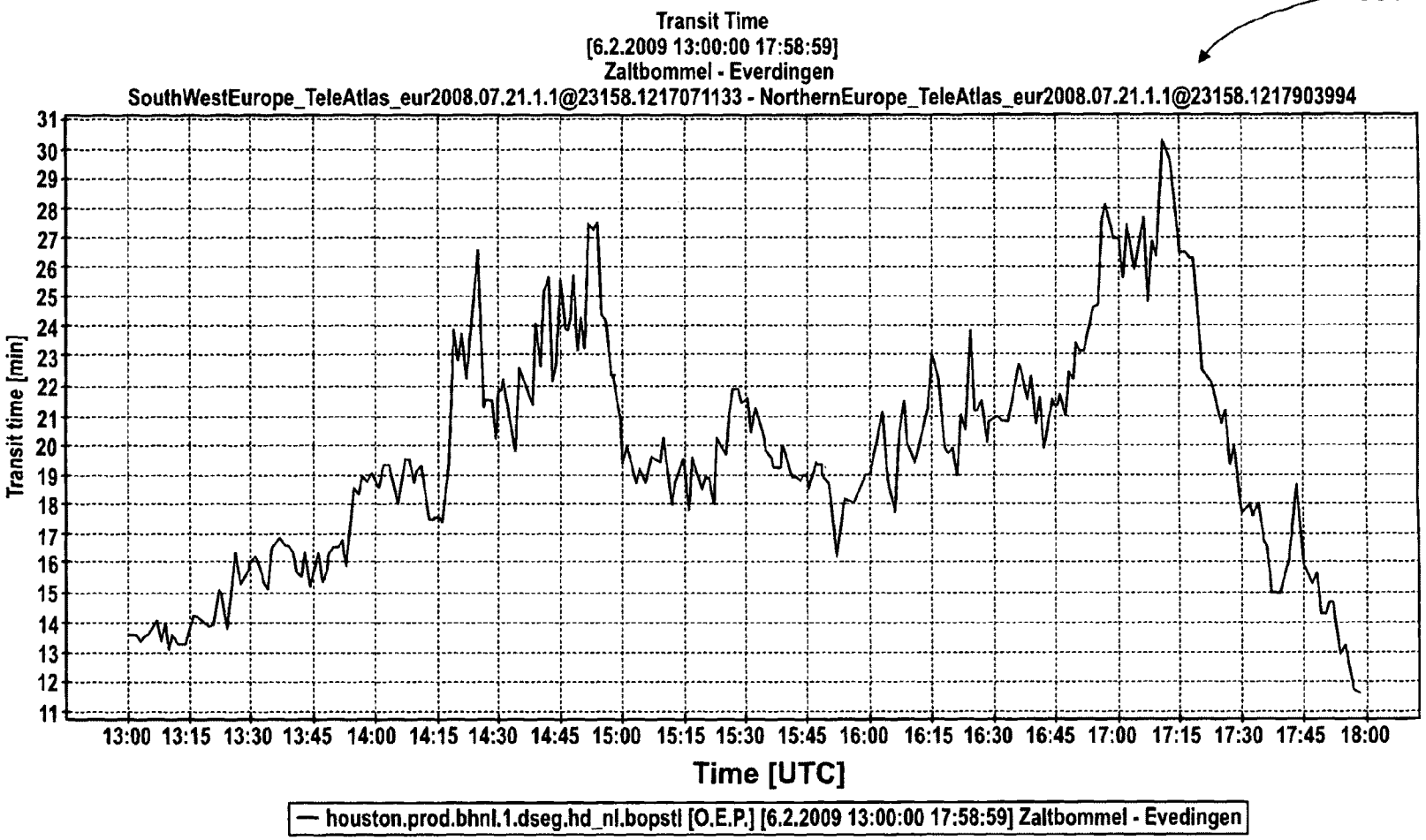
FIG. 9B illustrates a graph of time of day versus estimated travel time from an origin to a destination according to an example embodiment.

FIG. 9B illustrates a graph 950 of time of day versus estimated travel time from an origin A to a destination B. For example, a user may request an estimated travel time from the origin A to the destination B between 1 p.m. and 6 p.m. As described above, with reference to FIG. 8, GPS data are extracted that correspond to the requested information. The map-matched database software then calculates the average travel times based on the extracted GPS data.

Using known methods of graphing, the graph 950 is produced based on the extracted information. As shown in FIG. 9B, the highest estimated travel time from the origin A to the destination B occurs between 5 p.m. and 5:15 p.m. Therefore, a user may see what times are the slowest and what times are the fastest when traveling from the origin A to the destination B.

Figure 9C:
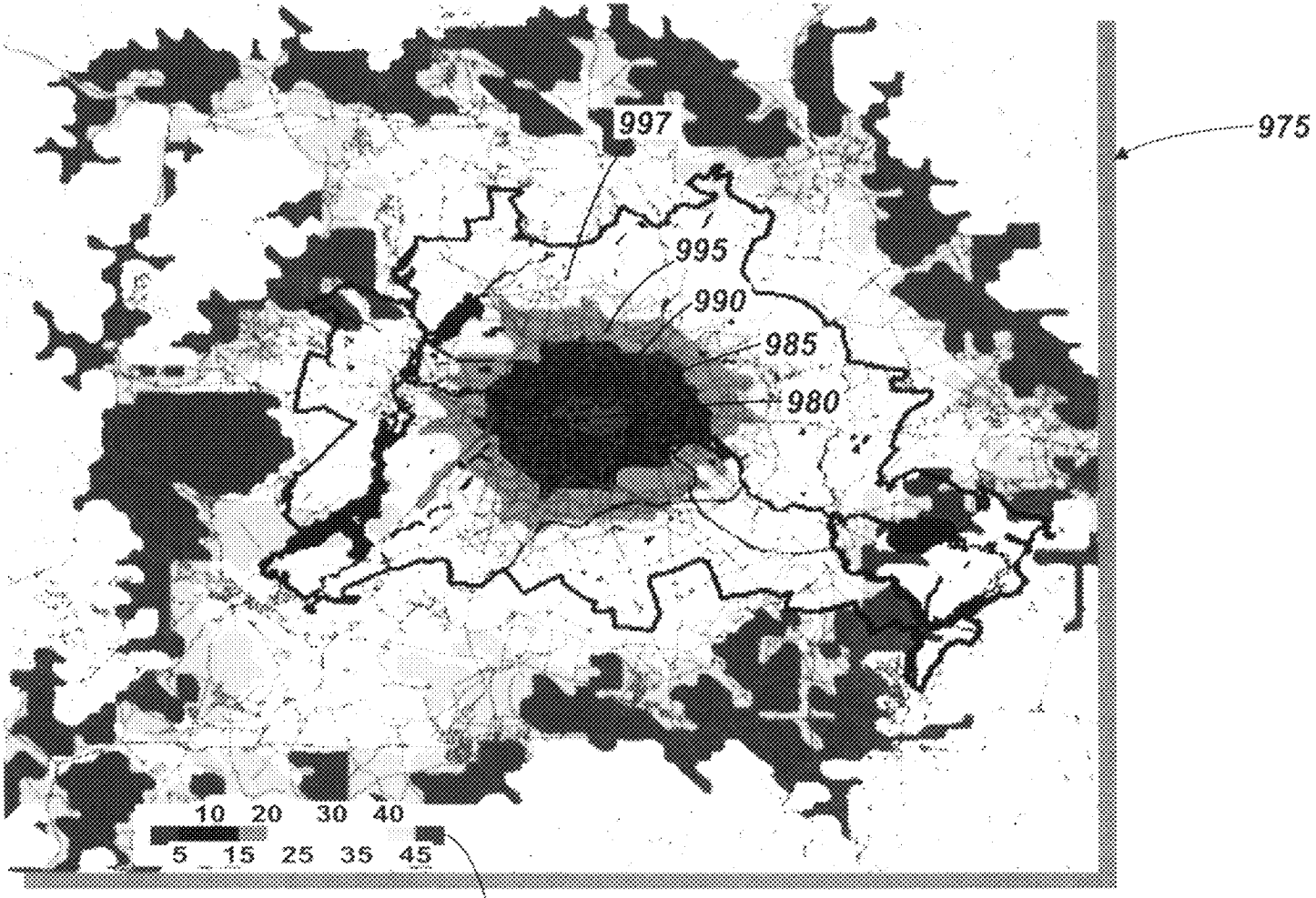
FIG. 9C illustrates a display for accessibility according to an example embodiment.

FIG. 9C illustrates a display for accessibility according to an example embodiment. More specifically, a display 975 that displays estimated travel time to a location 980 is shown. The location 980 may be any desired destination requested by the user such as a work place. Based on the user's selection, the map-matched software may determine the accessibility based on the extracted GPS data. The display 975 displays average travel times to the location 980 within a metropolitan area. While the location 980 is within a metropolitan area, it should be understood that a location within a suburb may be selected.

Area 985 is an area where the average travel time to the location 980 is less then five minutes, an area 990 illustrates an area where the average travel time is less than ten minutes, an area 995 illustrates an area where the average travel time is less than fifteen minutes, an area 997 illustrates an area where the average travel time is less than twenty minutes. More specifically, a key 999 illustrates the average travel time for a corresponding color. Based on the display 975, a user such as a government official may determine poorly accessible areas and roads. A user may zoom in on a particular road to get a closer view of accessibility of the road. Thus, travel times may be used for planning purposes.

Those areas outside of the area 997 are areas where the average travel time is greater than twenty minutes. As provided above, a user may request average travel times over a certain day and/or certain time of day, for example.

Figure 10:
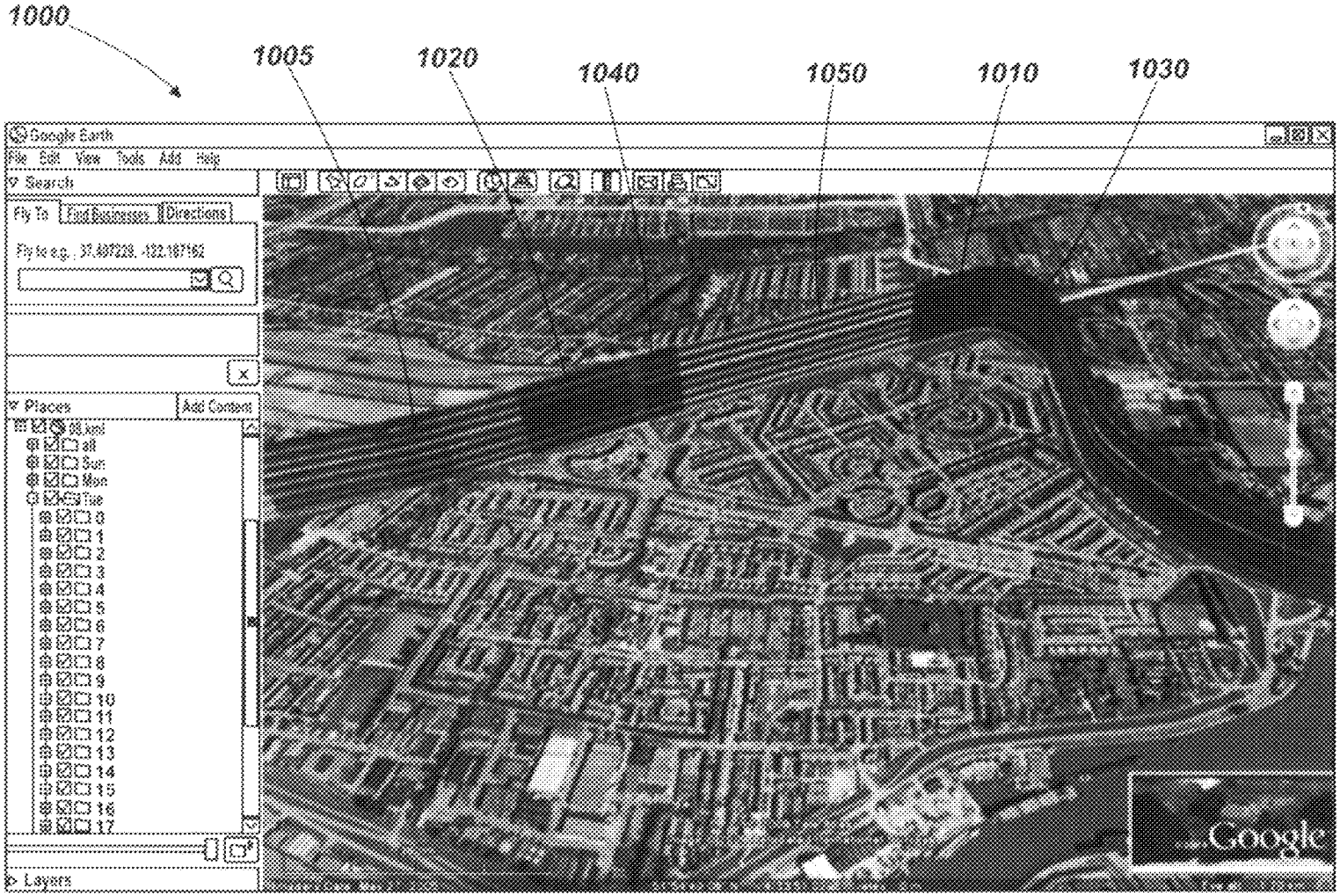
FIG. 10 illustrates an example embodiment of speed and bottleneck analysis display.

FIG. 10 illustrates an example embodiment of speed and bottleneck analysis display. FIG. 10 illustrates a display 1000 that illustrates a roadway 1005. The roadway 1005 is a stretch of road that a user requests traffic information such as travel times and speeds. The display 1000 is a GOOGLE EARTH™ display. However, it should be understood that various other displays may be used.

GPS data regarding the request from the user are extracted from the storage database (e.g., the storage database 530) for the roadway 1005. The different shades of color in the display 1000 represent different average speeds. A shown in FIG. 10, section 1010 is the slowest stretch of roadway 1005. Since a section 1050 is the lightest section of roadway 1005, the section 1050 is the fastest stretch of roadway. Sections 1020 and 1030 are the second slowest and section 1040 is the second fastest. Each of the sections 1010-1050 are defined by road sections (e.g., map segments 542) in the map-matched database (e.g., the map-matched database 540).

Moreover, a user may determine where traffic lights are based on the information displayed in the display 1000. More specifically, since the section 1010 is the slowest and the section 1050 is the fastest, there is a high likelihood that a traffic light exists in the section 1010. The delay could also be caused by other factors such as insufficient road capacity. Moreover, a user can compare morning to midday travel to see how speeds vary or how the speeds vary by day and time of day. For example, user may look at the traffic information displayed in the display 1000 for 8 a.m. to 9 a.m. and then the traffic information from 5 p.m. to 6 p.m. Moreover, it should be understood that it is possible to compare between hours, days or even longer periods such as weeks, months and years. It is possible to study the effects of changes to the network by analyzing information before and after changes are made.

Figure 11A:
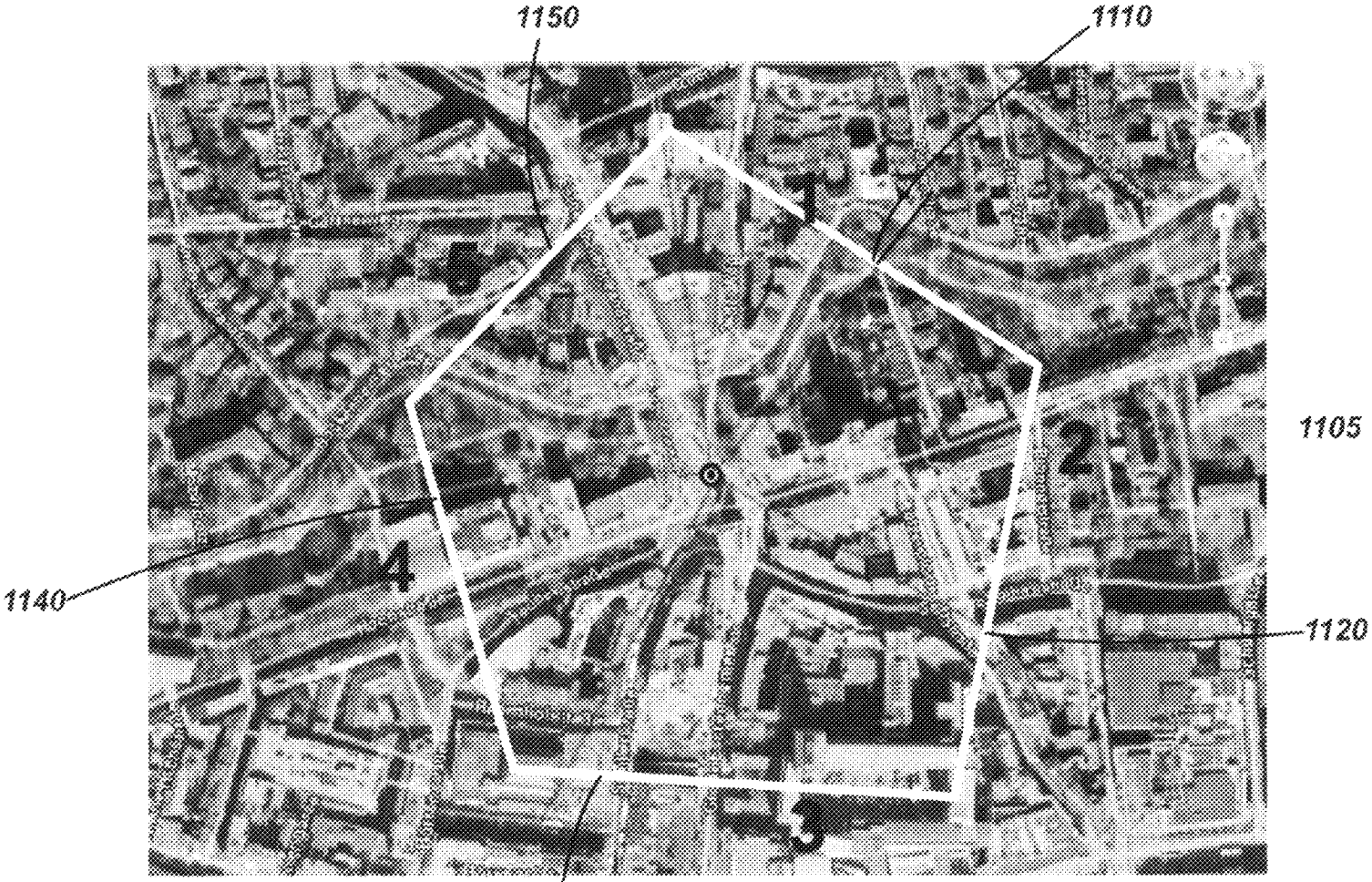
FIGS. 11A-11E illustrate various displays for intersection analysis according to an example embodiment.

FIGS. 11A-11E illustrates various displays for intersection analysis according to an example embodiment. FIG. 11A illustrates a display of an area having an intersection 1105 and areas 1110, 1120, 1130, 1140 and 1150 a user may travel to and from the intersection 1105. As described above with reference to FIG. 8, a user may request traffic information regarding intersection analysis. Here, a user requests an analysis of the intersection 1105. Therefore, GPS data regarding the request from the user are extracted from the storage database (e.g., the GPS storage database 530) for the intersection 1105. Based on the extracted GPS data, a user may see how many users travel from each of the sections 1110, 1120, 1130, 1140 and 1150, through the intersection 1105 and to another of the sections 1110, 1120, 1130, 1140 and 1150. The extracted GPS data may be filtered to mapped GPS data which passes between the sections 1110, 1120, 1130, 1140 and 1150.

Once the GPS data are extracted, the map-matched database software may produce graphs that illustrate the traffic flow through the intersection 1105.

FIGS. 11B-11E illustrate examples of graphs that illustrate the traffic flow through the intersection 1105 over time. Here, a twenty four hour time period is used. However, based on the description, it should be understood that any time period may used such as a rush hour time span (e.g., 4 p.m. to 7 p.m.).

Figure 11C:
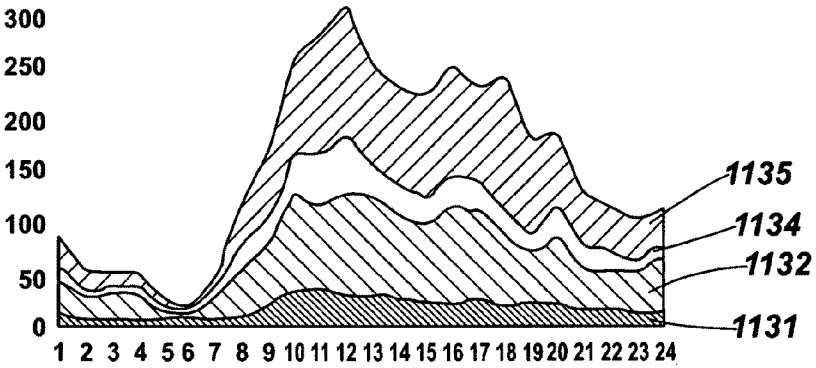
Figure 11B:
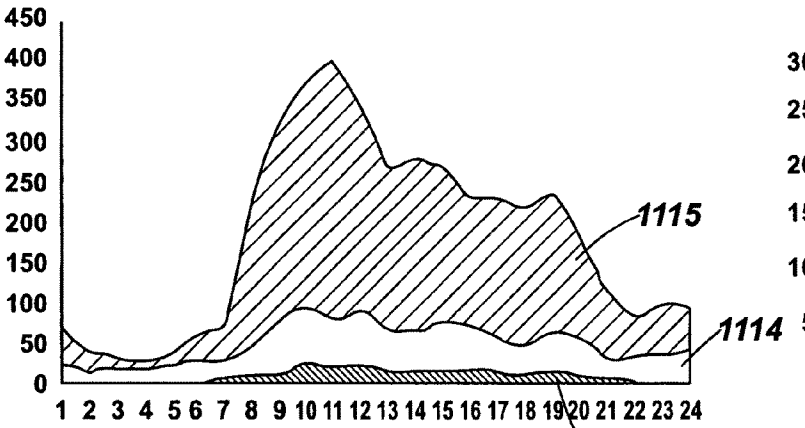

FIG. 11B illustrates the traffic flow from section 1110 to one of sections 1120, 1130, 1140 and 1150 through the intersection 1105 over time. An area 1112 shows the number of users that travel from the section 1110 to the section 1120 over time. Similarly, areas 1114 and 1115 show the number of users that travel from the section 1110 to the sections 1140 and 1150, respectively, over time.

FIG. 11C illustrates the traffic flow from section 1130 to one of sections 1110, 1120, 1140 and 1150 through the intersection 1105 over time. An area 1131 shows the number of users that travel from the section 1130 to the section 1110 over time. Similarly, areas 1132, 1134 and 1135 show the number of users that travel from the section 1130 to the sections 1120, 1140 and 1150, respectively, over time.

Figure 11E:
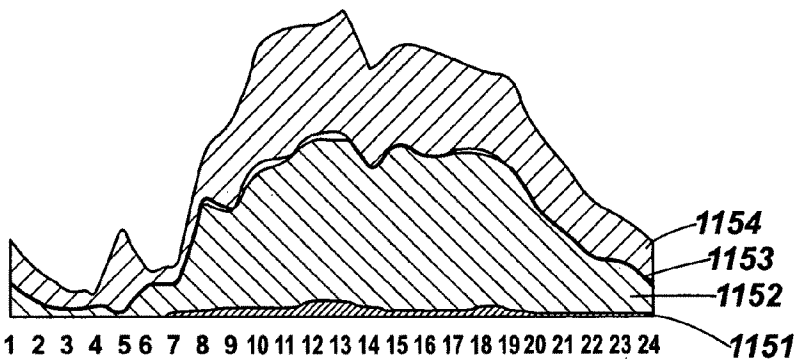
Figure 11D:
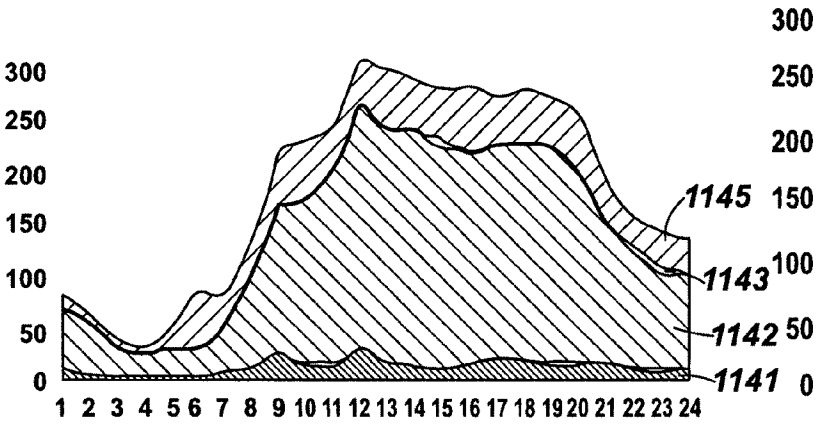

FIG. 11D illustrates the traffic flow from section 1140 to one of sections 1110, 1120, 1130 and 1150 through the intersection 1105 over time. An area 1141 shows the number of users that travel from the section 1140 to the section 1110 over time. Similarly, areas 1142, 1143 and 1145 show the number of users that travel from the section 1140 to the sections 1120, 1130 and 1150, respectively, over time.

FIG. 11E illustrates the traffic flow from section 1150 to one of sections 1110, 1120, 1130 and 1140 through the intersection 1105 over time. An area 1151 shows the number of users that travel from the section 1150 to the section 1110 over time. Similarly, areas 1152, 1153 and 1154 show the number of users that travel from the section 1150 to the sections 1120, 1130 and 1140, respectively, over time.

Based on the graphs of FIGS. 11B-11E, a user can see that a significant amount of users travel from the section 1110 to the section 1150 from hour 7 to hour 11. This could cause delays because the geometry of the intersection is poor or the traffic lights need to be adjusted to account for the large amounts of users traveling through the intersection 1105 from the section 1110 to the section 1150. Therefore, a government official may adjust the traffic lights to account for the proportions of traffic traveling through the intersection 1105.

Figure 12A:
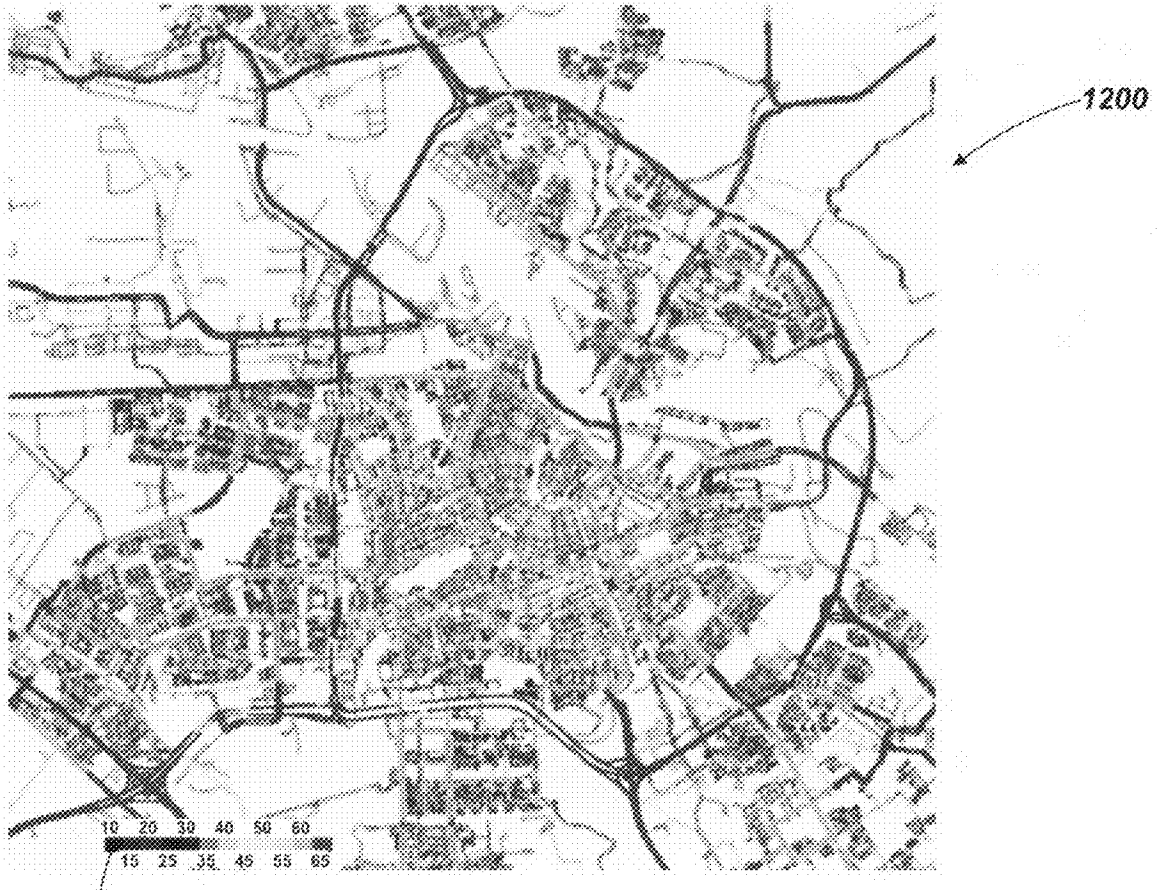
FIG. 12A illustrates a display using traffic cameras, speed limits and inductive loops to estimate travel time through a city.
Figure 12B:
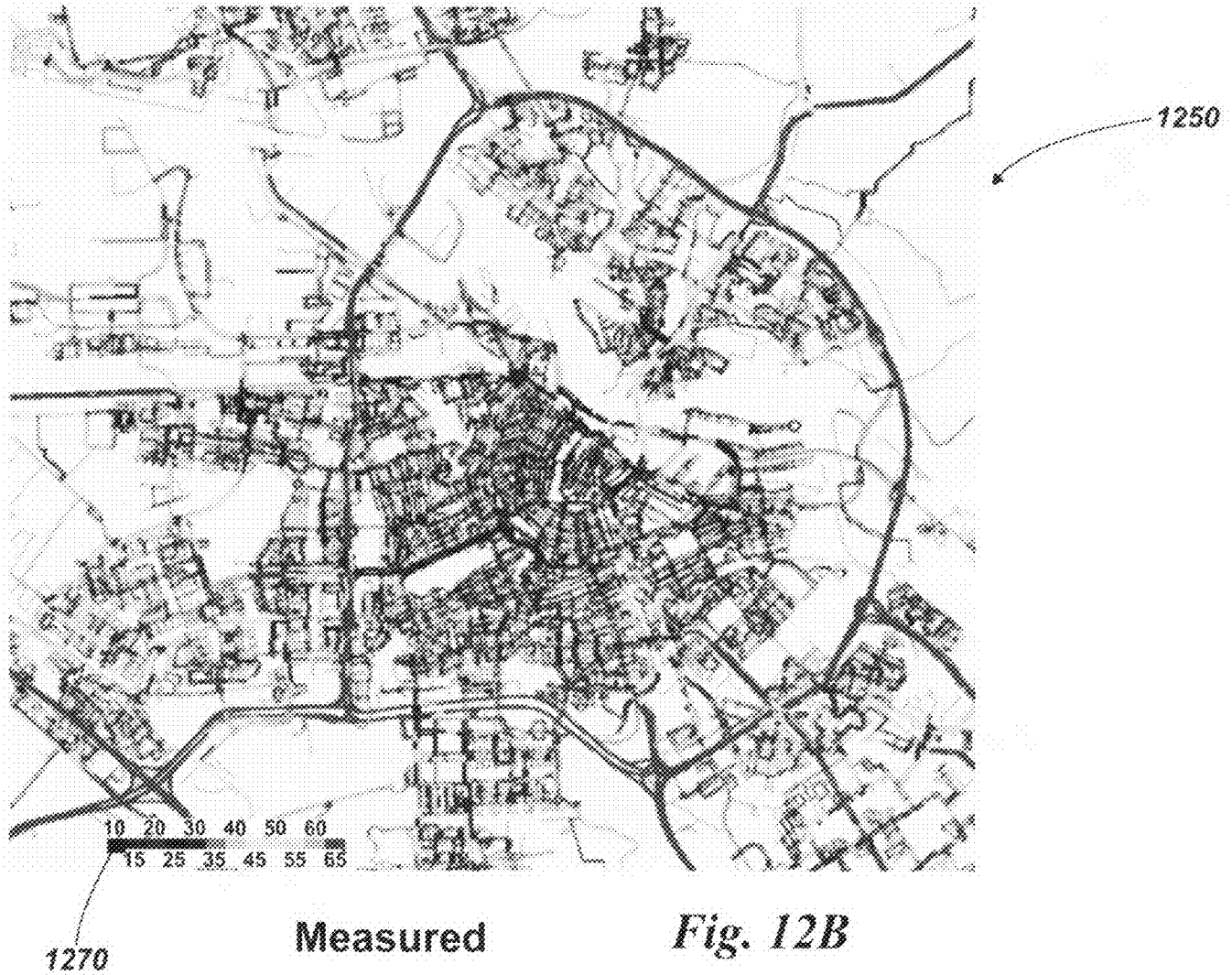
FIG. 12B illustrates a display of actual measured travel times through the city using the navigation devices to acquire GPS data according to an example embodiment.

FIGS. 12A-12B illustrate the benefits of using the user GPS data that is collected from the navigation devices as opposed to using the more expensive traffic cameras and inductive loops.

FIG. 12A illustrates a display 1200 using traffic cameras, speed limits and inductive loops to estimate travel time through a city. A key 1220 provides estimated travel times corresponding to shades in the display 1200.

FIG. 12B illustrates a display 1250 of actual measured travel times through the city using the navigation devices to acquire GPS data according to an example embodiment. A key 1270 provides the travel times corresponding to shades in the display 1250. As shown the measured travel times illustrated in FIG. 12B differ from the estimated travel times illustrated in FIG. 12A. Therefore, a government official may make better decisions for traffic planning purposes based on more accurate data.

Moreover, government officials may only have measurements for a limited amount of roads in a city due to the cost of implementing traffic cameras and inductive loops. However, the navigation devices are able to provide data for all roads that are traveled, thereby, generating more data and more accurate data. Moreover, the acquired data is updated all the time to continuously provide accurate data.

The methods of the embodiments expressed above may be implemented in the form of a device, such as a server and/or a navigation device for example. Thus, such aspects are encompassed within at least one embodiment of the present application.

Further, at least one of the methods of at least one embodiment may be implemented as a computer data signal embodied in the carrier wave or propagated signal that represents a sequence of instructions which, when executed by a processor (such as the processor 304 of the server 302, and/or the processor 210 of the navigation device 200, for example) causes the processor to perform a respective method. In at least one other embodiment, at least one method provided above may be implemented above as a set of instructions contained on a computer readable or computer accessible medium, such as one of the memory devices previously described, for example, to perform the respective method when executed by a processor or other computer device. In varying embodiments, the medium may be a magnetic medium, electronic medium and/or optical medium.

Even further, any of the aforementioned methods may be embodied in the form of a program. The program may be stored on a computer readable media and is adapted to perform any one of the aforementioned methods when run on a computer device (a device including a processor). Thus, the storage medium or computer readable medium, is adapted to store information and is adapted to interact with a data processing facility or computer device to perform the method of any of the above mentioned embodiments.

As one of ordinary skill in the art will understand upon reading the disclosure, the electronic components of the navigation device 200 and/or the components of the server 302 can be embodied as computer hardware circuitry or as a computer readable program, or as a combination of both.

The system and method of embodiments of the present application include software operative on the processor to perform at least one of the methods according to the teachings of the present application. One of ordinary skill in the art will understand, upon reading and comprehending this disclosure, the manner in which a software program can be launched from a computer readable medium in a computer based system to execute the functions found in the software program. One of ordinary skill in the art will further understand the various programming languages which may be employed to create a software program designed to implement and perform at least one of the methods of the present application.

The programs can be structured in an object-orientation using an object-oriented language including but not limited to JAVA, Smalltalk and C++, and the programs can be structured in a procedural-orientation using a procedural language including but not limited to COBAL and C. The software components can communicate in any number of ways that are well known to those of ordinary skill in the art, including but not limited to by application of program interfaces (API), interprocess communication techniques, including but not limited to report procedure call (RPC), common object request broker architecture (CORBA), Component Object Model (COM), Distributed Component Object Model (DCOM), Distributed System Object Model (DSOM), and Remote Method Invocation (RMI). However, as will be appreciated by one of ordinary skill in the art upon reading the present application disclosure, the teachings of the present application are not limited to a particular programming language or environment.

The above systems, devices, and methods have been described by way of example and not by way of limitation with respect to improving accuracy, processor speed, and ease of user interaction with a navigation device.

Further, elements and/or features of different example embodiments may be combined with each other and/or substituted for each other within the scope of this disclosure and appended claims.

Still further, any one of the above-described and other example features may be embodied in the form of an apparatus, method, system, computer program and computer program product. For example, any of the aforementioned methods may be embodied in the form of a system or device, including, but not limited to, any of the structure for performing the methodology illustrated in the drawings.

Example embodiments being thus described, it will be obvious that the same may be varied in many ways. Such variations are not to be regarded as a departure from the spirit and scope, and all such modifications as would be obvious to one skilled in the art are intended to be included within the scope of the following claims.

What is claimed is:

1. A computer implemented method of managing traffic by a system, the method comprising:

generating data associated with a digital map via a computer, the data generation comprising:

receiving sequential location measurements and an associated time from users of the system via the computer;

mapping the received sequential location measurements and the associated time to one or more segments of the digital map via the computer; and determining traffic information for a plurality of time periods based on the mapped sequential location measurements and the associated time corresponding to the plurality of time periods via the computer;

receiving a request for traffic information used to manage a road network infrastructure to control traffic associated with the road network from a requestor via the computer, wherein the request includes location data and information identifying one or more time periods and a traffic information type, wherein the traffic information type comprises an origin-destination pattern comprising an identification of a plurality of routes taken by traffic between the origin and the destination and percentages of the traffic that traveled along each of the plurality of routes between the origin and destination;

extracting the requested traffic information from the generated data via the computer; and displaying the traffic information to the requestor, the displaying comprising presenting, on a display device, a graph that represents the plurality of routes taken by the traffic between the origin and the destination and the percentages of the traffic that traveled along each of the plurality of routes between the origin and destination during the one or more time periods.

2. The method of claim 1, wherein the sequential location measurements are Global Positioning System (GPS) data.

3. The method of claim 2, wherein the receiving sequential location measurements includes receiving the GPS data periodically.

4. The method of claim 1, wherein the determining traffic information includes, determining an estimated travel time from a first location to a second location for a time period based on mapped sequential location measurements received from at least one user of the system traveling from a first location to a second location, wherein the first location and second location are included in the received mapped sequential location measurements.

5. The method of claim 1, wherein the determining traffic information includes, determining an estimated intersection usage for a time period based on mapped sequential location measurements received from at least one user.

6. The method of claim 1, wherein the sequential location measurements are collected by a navigation device.

7. The method of claim 6, wherein the navigation device is any one of a personal navigation device, a mobile phone, a personal digital assistant and an in vehicle device.

8. The method of claim 1, wherein traffic information includes at least one of: one or more travel times on the road network, one or more speeds on the road network and one or more measured speeds.

9. The method of claim 1, wherein traffic information includes at least one of: an overview of most used road segments in the road network and an overview of traffic bottleneck information for the road network.

10. The method of claim 1, wherein traffic information includes at least one of: flows of traffic between geographic areas and flows of traffic over complex intersections.

11. The method of claim 1, wherein the traffic information is used to generate and display at least one of: an accessibility report, a bottleneck analysis, an estimated time of travel through a city and an intersection analysis.

12. The method of claim 1, wherein the traffic information type further comprises one or more of: isochronal maps, selected link origin- destination flow patterns, rat runs, bottleneck analysis, intersection analysis, measured speeds and differences in speeds between peak and off-peak time periods.

13. A non-transitory computer readable medium which stores a set of instructions which when executed performs a method for managing traffic by a system, the method executed by the set of instructions comprising;

generating data associated with a digital map, the data generation comprising:

receiving sequential location measurements and an associated time from users of the system;

mapping the received sequential location measurements and the associated time to one or more segments of the digital map; and determining traffic information for a plurality of time periods based on the mapped sequential location measurements and the associated time corresponding to the plurality of time periods;

receiving a request for traffic information used to manage a road network infrastructure to control traffic associated with the road network from a requestor, wherein the request includes location data and information identifying one or more time periods and a traffic information type, wherein the traffic information type comprises an origin-destination pattern comprising an identification of a plurality of routes taken by traffic between the origin and the destination and percentages of the traffic that traveled along each of the plurality of routes between the origin and destination;

extracting the requested traffic information from the generated data; and displaying the traffic information to the requestor, the displaying comprising presenting, on a display device, a graph that represents the plurality of routes taken by the traffic between the origin and the destination and the percentages of the traffic that traveled along each of the plurality of routes between the origin and destination during the one or more time periods.

14. A system comprising:

a database configured to store sequential location measurements received from users of the system, the sequential location measurements including periodic times and associated coordinates; and a processor configured to:

generate data associated with a digital map, the data generation comprising:

receiving sequential location measurements and an associated time from users mapping the received sequential location measurements and the associated time to one or more segments of the digital map; and determining traffic information for a plurality of time periods based on the mapped sequential location measurements and the associated time corresponding to the plurality of time periods;

receive a request for traffic information used to manage a road network infrastructure to control traffic associated with the road network from a requestor, wherein the request includes location data and information identifying one or more time periods and a traffic information type, wherein the traffic information type comprises an origin-destination pattern comprising an identification of a plurality of routes taken by traffic between the origin and the destination and percentages of the traffic that traveled along each of the plurality of routes between the origin and destination;

extract the requested traffic information from the generated data and calculation; and display the traffic information to the requestor, the displaying comprising presenting, on a display device, a graph that represents the plurality of routes taken by the traffic between the origin and the destination and the percentages of the traffic that traveled along each of the plurality of routes between the origin and destination during the one or more time periods.

15. The system of claim 14, wherein the processor is configured to extract sequential location measurements for a previous second period that corresponds to a first time period, and determine traffic information based on the extracted sequential location measurements.

16. The system of claim 14, wherein the sequential location measurements are Global Positioning System (GPS) data.

17. The system of claim 16, wherein the GPS data includes time and longitudinal and latitudinal coordinates.

18. The system of claim 17, wherein the GPS data is received periodically.

19. The system of claim 14, wherein the processor is configured to determine an estimated travel time from a first location to a second location for a time period based on mapped sequential location measurements received from at least one user of the system traveling from a first location to a second location, wherein the first location and second location are included in the received mapped sequential location measurements.

20. The system of claim 14, wherein the processor is configured to determine an estimated intersection usage for a time period based on mapped GPS data received from at least one user.

21. The system of claim 14, wherein the sequential location measurements are anonymous.

22. The system of claim 14, wherein the sequential location measurements are collected by a navigation device.

* * * * *